US010076913B2

(12) United States Patent
Sato et al.

(10) Patent No.: US 10,076,913 B2
(45) Date of Patent: Sep. 18, 2018

(54) LIQUID EJECTING APPARATUS AND LIQUID FILLING METHOD AND CONTROL METHOD FOR THE SAME

(71) Applicant: SEIKO EPSON CORPORATION, Tokyo (JP)

(72) Inventors: Masahiko Sato, Matsumoto (JP); Hiroyuki Hagiwara, Matsumoto (JP); Takahiro Kanegae, Shiojiri (JP); Katsuhiro Okubo, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/418,124

(22) Filed: Jan. 27, 2017

(65) Prior Publication Data

US 2017/0217198 A1 Aug. 3, 2017

(30) Foreign Application Priority Data

Feb. 2, 2016 (JP) ..... 2016-017937
Sep. 1, 2016 (JP) ..... 2016-170968

(51) Int. Cl.
*B41J 2/175* (2006.01)
*B41J 2/19* (2006.01)
*B41J 2/155* (2006.01)

(52) U.S. Cl.
CPC ..... *B41J 2/17596* (2013.01); *B41J 2/155* (2013.01); *B41J 2/175* (2013.01); *B41J 2/17506* (2013.01); *B41J 2/19* (2013.01); *B41J 2202/19* (2013.01); *B41J 2202/20* (2013.01)

(58) Field of Classification Search
None
See application file for complete search history.

(56) References Cited

U.S. PATENT DOCUMENTS 8,172,379 B2 * 5/2012 Hagiwara ..... B41J 2/155 347/84
2008/0055376 A1 * 3/2008 Inoue ..... B41J 2/17513 347/86
2008/0252707 A1 10/2008 Kusunoki
2009/0147054 A1 * 6/2009 Yokouchi ..... B41J 2/175 347/54
2009/0267976 A1 10/2009 Lee et al.
(Continued)

FOREIGN PATENT DOCUMENTS

EP 1445105 A1 8/2004
EP 2088001 A2 8/2009
(Continued)

OTHER PUBLICATIONS

European Search Report for Application No. 17154172 dated Aug. 11, 2017.

*Primary Examiner* — Matthew Luu
*Assistant Examiner* — Tracey McMillion
(74) *Attorney, Agent, or Firm* — Workman Nydegger

(57) ABSTRACT

A liquid ejecting apparatus includes a liquid ejecting unit that ejects a liquid supplied to an internal flow path; a pump that feeds the liquid to the liquid ejecting unit; a discharge route that communicates with the internal flow path; and a closing valve disposed in the discharge route. The closing valve has an object that is biased to close the discharge route, and the object open the discharge route, due to an external force, during feeding of the liquid by the pump.

7 Claims, 19 Drawing Sheets

(56) References Cited

U.S. PATENT DOCUMENTS

| | | | | |
|---|---|---|---|---|
| 2010/0201765 | A1 | 8/2010 | Paku et al. | |
| 2012/0038719 | A1* | 2/2012 | Shimizu | B41J 2/17523 347/86 |
| 2014/0225945 | A1* | 8/2014 | Herman | B41J 2/175 347/6 |

FOREIGN PATENT DOCUMENTS

| | | |
|---|---|---|
| JP | 2002-144576 | 5/2002 |
| JP | 2007015409 A | 1/2007 |
| JP | 2008-062396 | 3/2008 |
| JP | 2010-201925 | 9/2010 |

* cited by examiner

<CLOSED STATE>

<OPENED STATE>

LIQUID EJECTING APPARATUS AND LIQUID FILLING METHOD AND CONTROL METHOD FOR THE SAME

CROSS-REFERENCE TO RELATED APPLICATIONS

The present application claims priority to Japanese Patent Application No. 2016-017937, filed Feb. 2, 2016, and Japanese Patent Application No. 2016-170968, filed Sep. 1, 2016, which applications are hereby incorporated by reference herein.

BACKGROUND

1. Technical Field

The present invention relates to technology of ejecting a liquid such as an ink.

2. Related Art

A liquid ejecting head that ejects a liquid such as an ink has been proposed in the related art. In a case where the liquid ejecting head is filled with the liquid (hereinafter, referred to as "initial filling"), air, with which a space inside the liquid ejecting head is filled, needs to be discharged. In addition, in a state in which the space inside the liquid ejecting head is filled with the liquid, it is important that bubbles mixed with the liquid be discharged. In this respect, JP-A-2002-144576 discloses a configuration in which a bubble outlet for discharging gases is disposed in a ceiling surface of a common liquid chamber in which a liquid that is supplied to a plurality of nozzles is stored.

However, in the technology disclosed in JP-A-2002-144576, there is a possibility that the liquid stored in the common liquid chamber will leak through the bubble outlet or that bubbles from the bubble outlet will be mixed in the common liquid chamber.

SUMMARY

An advantage of some aspects of the invention is to reduce an amount of a liquid leak or an amount of a mixture with bubbles flowing via a route for discharging gases from a space inside a liquid ejecting unit.

Aspect 1

According to a preferred aspect (aspect 1) of the invention, there is provided a liquid ejecting apparatus including: a liquid ejecting unit that ejects a liquid supplied to an internal flow path; a liquid pressure-feeding mechanism that feeds the liquid to the liquid ejecting unit; a discharge route that communicates with the internal flow path; and a closing valve disposed in the discharge route, The closing valve has a moving object that is biased to close the discharge route, and the moving object is movable, due to an external force, to an opening position at which the discharge route is opened when the liquid pressure-feeding mechanism feeds the liquid. In this configuration, when the liquid is fed from the liquid pressure-feeding mechanism to the liquid ejecting unit, the moving object is caused to move due to the external force to an opening position at which the discharge route is opened. In this manner, it is possible to efficiently fill the internal flow path of the liquid ejecting unit with liquids. On the other hand, since the moving object is biased to close the discharge route, a possibility that bubbles are mixed with the liquid in the internal flow path via the discharge route, or a possibility that the liquid in the internal flow path will leak via the discharge route is reduced.

Aspect 2

In the liquid ejecting apparatus of a preferred example (Aspect 2) according to Aspect 1, the moving object may move to the opening position due to the external force that is applied from a front end portion of an exhaust unit inside which a communicating flow path communicating with an opening on the front end portion side is formed. In this configuration, the insertion of the exhaust unit simply enables the moving object of the closing valve to move to the opening position. In addition, since the communicating flow path communicating with the opening on the front end portion side is formed inside the exhaust unit, the liquid discharged to the discharge route from the internal flow path of the liquid ejecting unit is stored in the communicating flow path of the exhaust unit. Hence, it is possible to reduce a possibility that the liquid will spill via the discharge route.

Aspect 3

In the liquid ejecting apparatus of a preferred example (Aspect 3) according to Aspect 2, the closing valve may have a seal portion that seals a gap between an inner circumferential surface of the discharge route and an outer circumferential surface of the exhaust unit on a base end side when viewed from the opening. In this configuration, since the seal portion of the closing valve seals the gap between the outer circumferential surface of the exhaust unit and the inner circumferential surface of the discharge route, it is possible to reduce a possibility that the liquid will leak via the gap between the outer circumferential surface of the exhaust unit and the inner circumferential surface of the discharge route.

Aspect 4

In the liquid ejecting apparatus of a preferred example (Aspect 4) according to Aspect 3, the seal portion may come into contact with the moving object to which the external force is not applied. In this configuration, the seal portion comes into contact with the moving object to which the external force is not applied. In other words, the seal portion is commonly used to seal the gap between the outer circumferential surface of the exhaust unit and the inner circumferential surface of the discharge route and to seal the gap between the moving object and the inner circumferential surface of the discharge route. Hence, an advantage is achieved in that a structure of the closing valve is simplified, compared to a configuration of using separate members for both cases of the sealing.

Aspect 5

In the liquid ejecting apparatus of a preferred example (Aspect 5) according to any one of Aspects 2 to 4, the exhaust unit may include a gas permeable membrane that closes the communicating flow path. In this configuration, since the gas permeable membrane is disposed to close the communicating flow path of the exhaust unit, it is possible to reduce a possibility that the liquid having flowed in the communicating flow path from the discharge route will leak.

Aspect 6

In the liquid ejecting apparatus of a preferred example (Aspect 6) according to any one of Aspects 2 to 5, the liquid pressure-feeding mechanism may stop the liquid from being fed, in response to a detection result from a liquid surface sensor that detects a liquid surface in the communicating flow path. In this configuration, the liquid pressure-feeding mechanism stops the liquid from being fed, in response to the detection result of the liquid surface sensor that detects the liquid surface in the communicating flow path. For example, in a case where the liquid surface in the communicating flow path is higher than a predetermined reference surface, the liquid is stopped from being fed. Hence, it is possible to reduce an occurrence of an excessive supply of the liquid to the liquid ejecting unit.

Aspect 7

In the liquid ejecting apparatus of a preferred example (Aspect 7) according to any one of Aspects 2 to 5, the liquid pressure-feeding mechanism may stop the liquid from being fed, in response to a detection result of a liquid discharged from a nozzle of the liquid ejecting unit. In this configuration, the liquid pressure-feeding mechanism stops the liquid from being fed, in response to the detection result of the liquid discharged from the nozzle of the liquid ejecting unit. For example, in a case where a leak of a liquid from the nozzle of the liquid ejecting unit is detected, the liquid is stopped from being fed. Hence, it is possible to reduce an occurrence of an excessive supply of the liquid to the liquid ejecting unit.

Aspect 8

According another preferred aspect (Aspect 8), there is provided a liquid ejecting apparatus including: a liquid ejecting head that ejects a liquid supplied to an internal flow path; and an exhaust unit that is attachable to and detachable from the liquid ejecting head and has a gas permeable membrane through which gases in the internal flow path permeate. In this configuration, the gases in the internal flow path of the liquid ejecting head permeate and are discharged through the gas permeable membrane of the exhaust unit that is attachable to and detachable from the liquid ejecting head. Hence, it is possible to efficiently fill the internal flow path of the liquid ejecting head with a liquid. Note that the state of the exhaust unit "being attachable to and detachable from" the liquid ejecting head means that the exhaust unit is able to be mounted on or removed from the liquid ejecting head with no degradation in gas permeability of the gas permeable membrane in a state in which no liquid is attached to the gas permeable membrane. For example, "no degradation in the gas permeability" means that the gas permeable membrane has substantially the same function in a state in which the gas permeable membrane is mounted on the liquid ejecting head for the first time and in a state in which the gas permeable membrane is mounted on the liquid ejecting head for the second time after the gas permeable membrane is removed from the head once (when remounted).

Aspect 9

According still another preferred aspect (Aspect 9), there is provided a liquid ejecting apparatus including: a liquid ejecting head that ejects a liquid supplied to an internal flow path; and an exhaust unit that is attachable to and detachable from the liquid ejecting head and has an atmosphere-open route for discharging gases in the internal flow path. In this configuration, the gases in the internal flow path of the liquid ejecting head are discharged via the atmosphere-open route of the exhaust unit that is attachable to and detachable from the liquid ejecting head. Hence, it is possible to efficiently fill the internal flow path of the liquid ejecting head with a liquid.

Aspect 10

In the liquid ejecting apparatus of a preferred example (Aspect 10) according to Aspect 9, the exhaust unit may include a needle-shaped inserting portion inside which a communicating flow path is formed and may be mounted on the liquid ejecting head through insertion of the inserting portion, the gases in the internal flow path may be discharged via the communicating flow path and the atmosphere-open route, and a flow passage area of the atmosphere-open route may be smaller than a flow passage area of the communicating flow path. In this configuration, since the flow passage area of the atmosphere-open route is smaller, a meniscus is easily formed on an inner side of the atmosphere-open route in a case where the liquid reaches the inside of the exhaust unit from the internal flow path of the liquid ejecting head. Hence, when the exhaust unit is removed from the liquid ejecting head, an advantage is achieved in that the liquid inside the exhaust unit is difficult to leak to the outside thereof. In addition, since the flow passage area of the atmosphere-open route is smaller (a flow-path resistance increases), an advantage is achieved in that the liquid reaching the inside of the exhaust unit is difficult to approach the atmosphere-open route.

Aspect 11

In the liquid ejecting apparatus of a preferred example (Aspect 11) according to Aspects 8 to 10, the exhaust unit may include, inside, an absorber that holds a liquid. In this configuration, since the absorber that holds the liquid is disposed inside the exhaust unit, an advantage is achieved in that the liquid inside the exhaust unit is difficult to leak to the outside thereof when the exhaust unit is removed from the liquid ejecting head, even in a case the liquid reaches the inside of the exhaust unit from the internal flow path of the liquid ejecting head.

Aspect 12

The liquid ejecting apparatus of a preferred example (Aspect 12) according to any one of Aspects 8 to 11 may further include a transport member that transports the liquid ejecting head, in which the transport member transports an attaching/detaching portion between the liquid ejecting head and the exhaust unit. In this configuration, the exhaust unit is disposed in the vicinity of the liquid ejecting head. Hence, it is possible to reduce an amount of a liquid required for filling the liquid ejecting head with the liquid.

Aspect 13

In the liquid ejecting apparatus of a preferred example (Aspect 13) according to Aspects 8 to 12, the exhaust unit may include a needle-shaped inserting portion inside which a communicating flow path is formed, the inserting portion may have an opening through which the internal flow path and the communicating flow path communicate with each other in a state in which the exhaust unit is mounted on the liquid ejecting head through the insertion of the inserting portion, and a flow passage area of the opening may be smaller than a flow passage area of the communicating flow path. In this configuration, since the flow passage area of the opening formed in the inserting portion is smaller than the flow passage area of the communicating flow path, a meniscus is easily formed on the inner side of the opening. Hence, an advantage is achieved in that the liquid inside the exhaust unit is difficult to leak to the outside thereof when the exhaust unit is removed from the liquid ejecting head, even in the case where the exhaust unit is removed from the liquid ejecting head in a state in which the liquid reaches the communicating flow path from the internal flow path of the liquid ejecting head.

Aspect 14

In the liquid ejecting apparatus of a preferred example (Aspect 14) according to any one of Aspects 8 to 13, the liquid ejecting head may include a closing valve disposed on the internal flow path, and the exhaust unit may open the closing valve, with the exhaust unit mounted on the liquid ejecting head. In this configuration, the exhaust unit mounted on the liquid ejecting head is able to efficiently discharge the gases in the internal flow path of the liquid ejecting head.

Aspect 15

In the liquid ejecting apparatus of a preferred example (Aspect 15) according to Aspects 8 to 14, the liquid ejecting head may include a liquid ejecting module that ejects a liquid, and a support member that supports the liquid ejecting module, in which the liquid ejecting module may be attachable to and detachable from the support member, and an attaching/detaching direction of the liquid ejecting module to and from the support member may be the same as an attaching/detaching direction of the exhaust unit to and from the liquid ejecting head. In this configuration, since the attaching/detaching direction of the liquid ejecting module to and from the support member is common to the attaching/detaching direction of the exhaust unit to and from the liquid ejecting head, an advantage is achieved in that it is easy to perform attaching/detaching operations of the liquid ejecting module and the exhaust unit, respectively.

Aspect 16

In the liquid ejecting apparatus of a preferred example (Aspect 16) according to any one of Aspects 8 to 15, the liquid ejecting head may include a liquid ejecting module that ejects a liquid, and a flow-path component that communicates with the liquid ejecting module, and the liquid ejecting module and the exhaust unit may be individually attachable to and detachable from the flow-path component. In this configuration, since the liquid ejecting module and the exhaust unit are individually attachable to and detachable from the flow-path component, an advantage is achieved in that a position of one of the liquid ejecting module and the exhaust unit is difficult (difficult to have a positional shift) to change during attachment and detachment of the other one.

Aspect 17

In the liquid ejecting apparatus of a preferred example (Aspect 17) according to any one of Aspects 8 to 16, the liquid ejecting head may include a plurality of liquid ejecting modules that eject liquids, and flow-path component that communicates with the liquid ejecting modules, and the exhaust unit may be attachable to and detachable from the flow-path component, and the flow-path component may cause the plurality of liquid ejecting modules and the exhaust unit to communicate with each other. In this configuration, a single exhaust unit is able to discharge the gases in the internal flow paths in the plurality of liquid ejecting modules.

Aspect 18

According still another preferred aspect (Aspect 18), there is provided a liquid ejecting apparatus including: a liquid pressure-feeding mechanism that feeds a liquid to a liquid ejecting unit that ejects the liquid; and a pressure regulating mechanism that causes the liquid pressure-feeding mechanism to perform a pressurizing operation of supplying air to the liquid ejecting head, or a depressurizing operation of suctioning air from the liquid ejecting head. In this configuration, the pressure-feeding and the pressurizing operation or the depressurizing operation of the liquid causes the liquid ejecting head to function appropriately.

Aspect 19

According still another preferred aspect (Aspect 19), there is provided a liquid filling method for a liquid ejecting apparatus that that includes a liquid ejecting unit that ejects a liquid supplied to an internal flow path, a discharge route that communicates with the internal flow path, and a closing valve having a moving object that is biased to close the discharge route, the method including: during feeding a liquid to the liquid ejecting unit, causing, due to an external force, the moving object to move to an opening position at which the discharge route is opened.

Aspect 20

According still another preferred example (Aspect 20), there is provided a control method for a liquid ejecting apparatus that that includes a liquid ejecting head that ejects a liquid, a liquid pressure-feeding mechanism that feeds the liquid to the liquid ejecting head; and a pressure regulating mechanism that causes a pressurizing operation of supplying air to the liquid ejecting head, or a depressurizing operation of suctioning air from the liquid ejecting head, the method including: during feeding the liquid to the liquid ejecting head, causing the pressure regulating mechanism to perform the pressurizing operation or the depressurizing operation. In this configuration, since the pressure-feeding to the liquid ejecting head and the pressurizing operation or the depressurizing operation of the liquid is simultaneously performed, it is possible to shorten a period of time during which the liquid ejecting head is operated.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
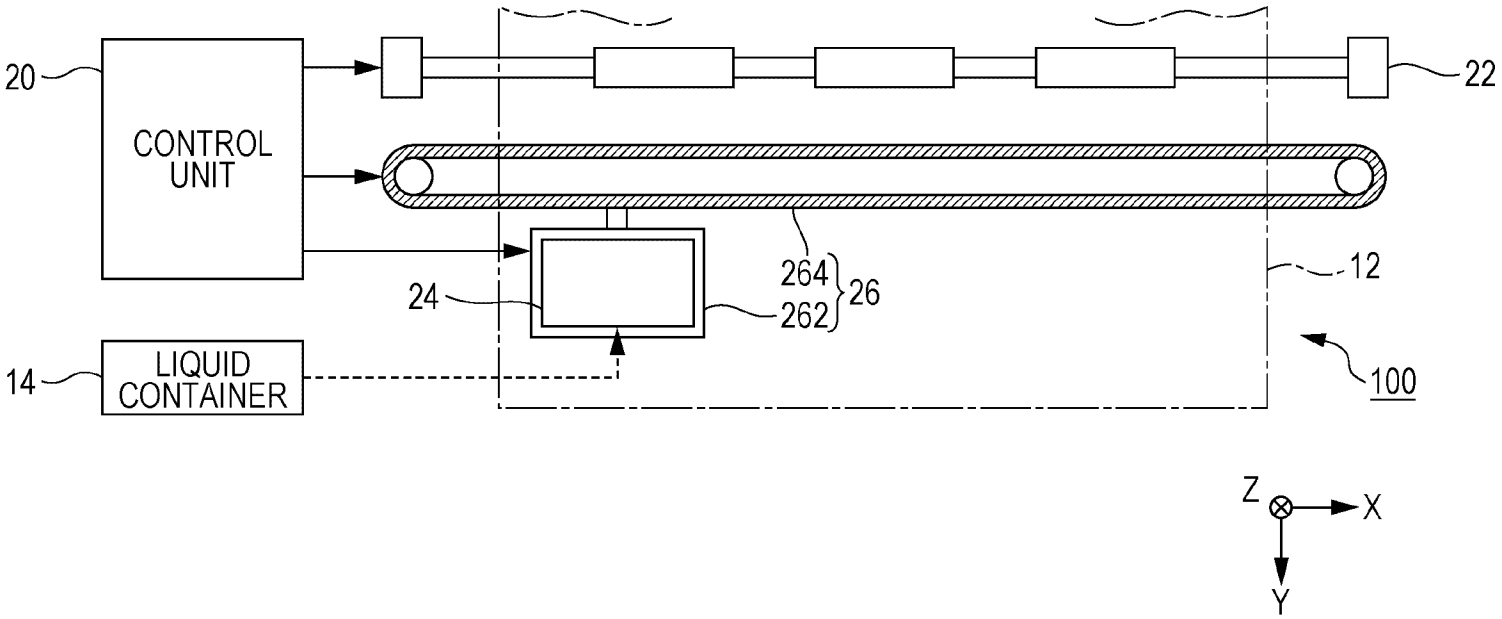
FIG. 1 is a diagram of a configuration of a liquid ejecting apparatus according to a first embodiment of the invention.

FIG. 1 is a diagram of a configuration of a liquid ejecting apparatus 100 according to the first embodiment of the invention. The liquid ejecting apparatus 100 of the first embodiment is an ink jet type printing apparatus that ejects an ink as an example of a liquid to a medium 12. The medium 12 is a common printing sheet, and any printing target of a resin film, a cloth material, or the like can be used as the medium 12. A liquid container 14 that stores inks is fixed to the liquid ejecting apparatus 100. For example, a cartridge, a pouch-shaped ink bag formed of a flexible film, or a refillable ink tank, which is attachable to and detachable from the liquid ejecting apparatus 100, is used as the liquid container 14. A plurality of different color inks are stored in the liquid container 14.

As illustrated in FIG. 1, the liquid ejecting apparatus 100 includes a control unit 20, a transport mechanism 22, and a liquid ejecting head 24. The control unit 20 is configured to include a control device such as a central processing unit (CPU) or a field programmable gate array (FPGA), and a recording device such as a semiconductor memory, (which are not illustrated), and the control device executes a program stored in the recording device. In this manner, the control unit collectively controls every element in the liquid ejecting apparatus 100. The transport mechanism 22 transports the medium 12 in a Y direction, under the control by the control unit 20.

The liquid ejecting apparatus 100 of the first embodiment includes a moving mechanism 26. The moving mechanism 26 causes the liquid ejecting head 24 to reciprocate in an X direction, under the control by the control unit 20. The X direction in which the liquid ejecting head 24 reciprocates is a direction intersecting with (commonly, orthogonal to) the Y direction in which the medium 12 is transported. The moving mechanism 26 of the first embodiment includes a transport member 262 and a transport belt 264. The transport member 262 has a substantially box-shaped structure (carriage) that supports the liquid ejecting head 24 and is fixed to the transport belt 264. The transport belt 264 is an endless belt looped in the X direction. The transport belt 264 rotates under the control of the control unit 20 and thereby the liquid ejecting head 24 reciprocates along with the transport member 262 in the X direction. Note that it is possible to mount the liquid container 14 along with the liquid ejecting head 24 on the transport member 262.

The liquid ejecting head 24 ejects, to the medium 12, inks supplied from the liquid container 14, under the control by the control unit 20. The liquid ejecting head 24 ejects the inks to the medium 12 within a period in which the transport mechanism 22 transports the medium 12 and the moving mechanism 26 transports the liquid ejecting head 24. In this manner, a desired image is formed on the medium 12. In the following description, a direction perpendicular to an X-Y plane is referred to as a Z direction. The inks ejected from the liquid ejecting head 24 travel on a positive side of the Z direction and land on a front surface of the medium 12.

Figure 2:
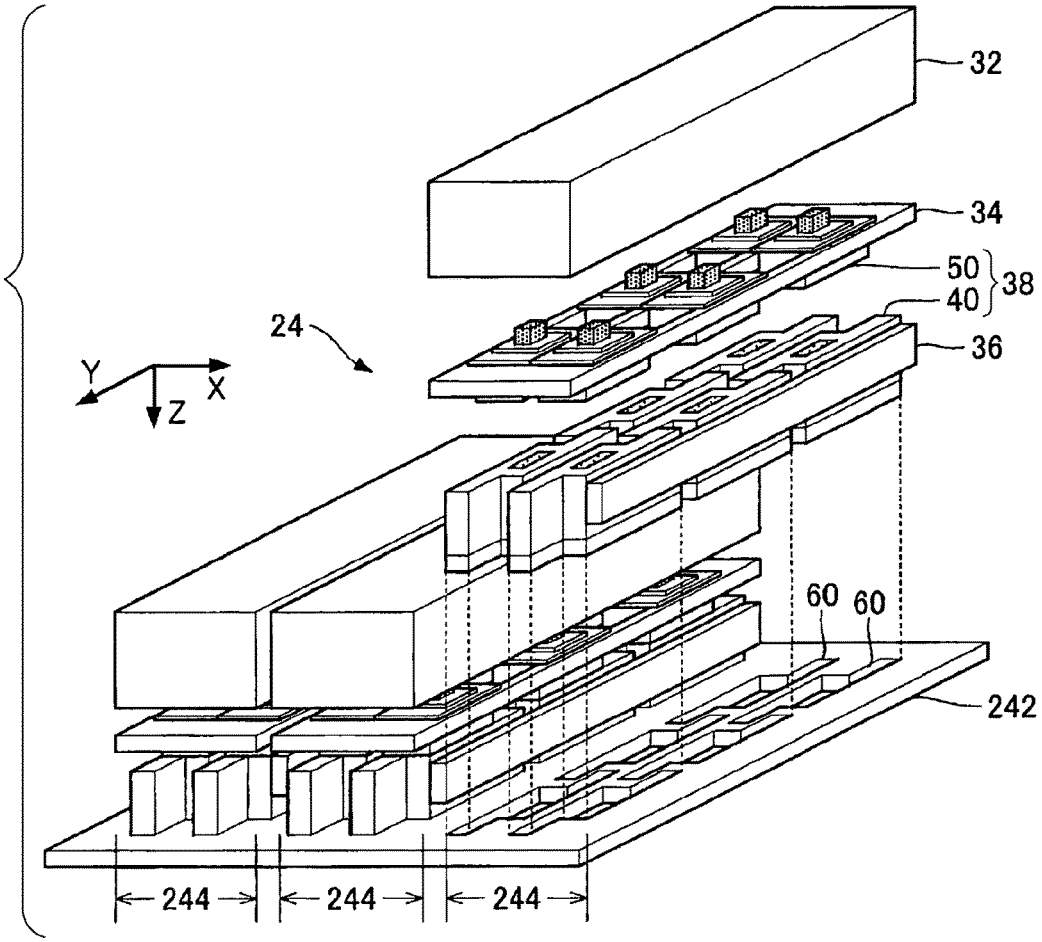
FIG. 2 is an exploded perspective view of a liquid ejecting head.

FIG. 2 is an exploded perspective view of the liquid ejecting head 24. As illustrated in FIG. 2, the liquid ejecting head 24 of the first embodiment includes a first support member 242 and a plurality of assemblies 244. The first support member 242 is a plate-shaped member (support for the liquid ejecting head) that supports the plurality of assemblies 244. The plurality of assemblies 244 are fixed to the first support member 242 in a state of being arranged side by side in the X direction. Regarding a single assembly 244 which is representatively illustrated, each of the plurality of assemblies 244 includes a connecting unit 32, a second support member 34, a flow-path component 36, and a plurality of (six in the first embodiment) liquid ejecting modules 38. Note that the total number of assemblies 244 that configure the liquid ejecting head 24 and the total number of liquid ejecting modules 38 that configure the assembly 244 are not limited the number illustrated in an example in FIG. 2.

Figure 3:
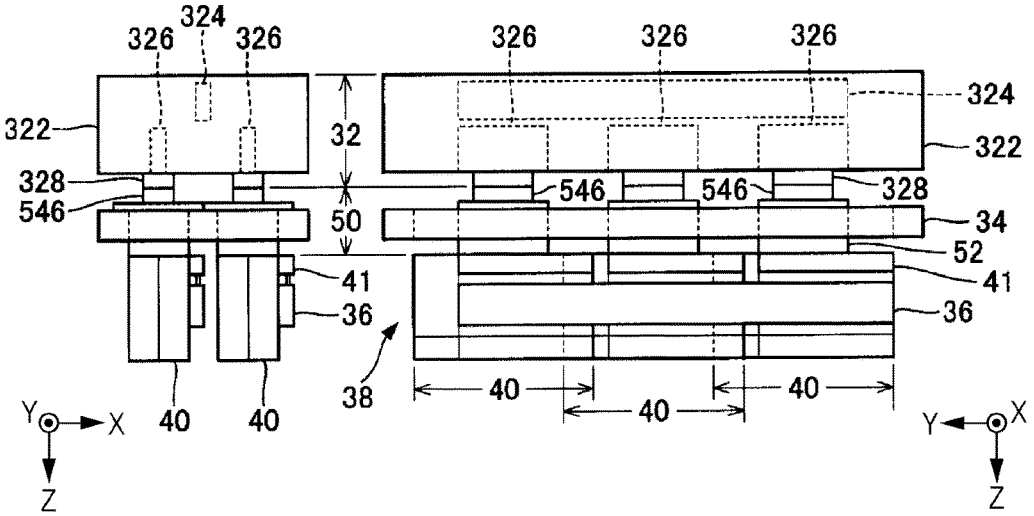
FIG. 3 is a side view of an assembly.

FIG. 3 is a front view and a side view of any one assembly 244. As understood in FIGS. 2 and 3, schematically, two rows of the plurality of liquid ejecting modules 38 are disposed in the second support member 34 positioned immediately below the connecting unit 32, and the flow-path component 36 is disposed on sides of the plurality of liquid ejecting module 38. The flow-path component 36 has a structure inside which flow paths through which inks supplied from the liquid container 14 are distributed to the plurality of liquid ejecting modules 38, respectively, are formed, and the flow-path component is configured to elongate in the Y direction so as to stretch over the plurality of liquid ejecting modules 38.

As illustrated in FIG. 3, the connecting unit 32 includes a housing 322, a relay substrate 324, and a plurality of drive substrates 326. The housing 322 has a substantially box-shaped structure in which the relay substrate 324 and the plurality of drive substrates 326 are accommodated. Each of the plurality of drive substrates 326 is a wiring substrate corresponding to the liquid ejecting module 38. A signal generating circuit that generates a drive signal having a predetermined waveform is installed in the drive substrate 326, and a power-supply voltage and a control signal that specifies ejection or non-ejection of inks for each nozzle are supplied along with the drive signal to the liquid ejecting module 38 from the drive substrate 326. It is also possible to install, in the drive substrate 326, an amplifier circuit that amplifies the drive signal. The relay substrate 324 is a wiring substrate for relaying an electrical signal or a power-supply voltage between the control unit 20 and the plurality of drive substrates 326, and is common to the plurality of liquid ejecting modules 38. As illustrated in FIG. 3, connecting portions 328 (an example of a second connecting portion), which are electrically connected to the drive substrates 326 different from each other, are disposed on an underside of the housing 322. The connecting portion 328 is a connector (board to board connector) for an electrical connection.

Figure 4:
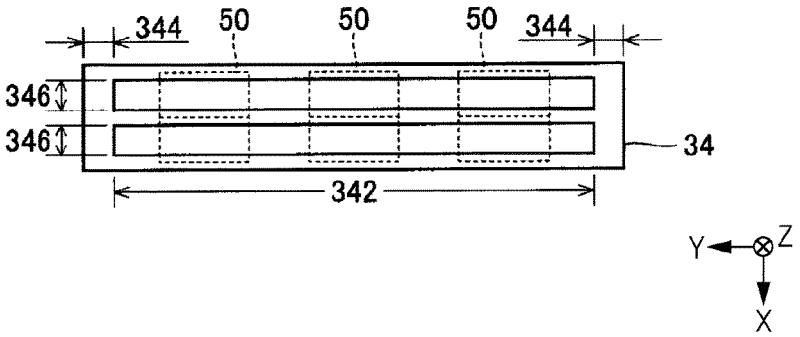
FIG. 4 is a plan view of a second support member.

FIG. 4 is a plan view of the second support member 34. As illustrated in FIGS. 3 and 4, the second support member 34 has a structure (frame) elongating in the Y direction, and includes a plurality of (three in an example illustrated in FIG. 4) support portions 342, which extend in the Y direction at intervals therebetween in the X direction, and linking portions 344 that links end portions of the support portions 342 to each other. In other words, the second support member 34 is a flat plate member in which two openings 346 elongating in the Y direction are formed at intervals in the X direction. The linking portions 344 of the second support member 34 are fixed to the first support member 242 at positions of a front surface of the first support member 242 at intervals.

Figure 5:
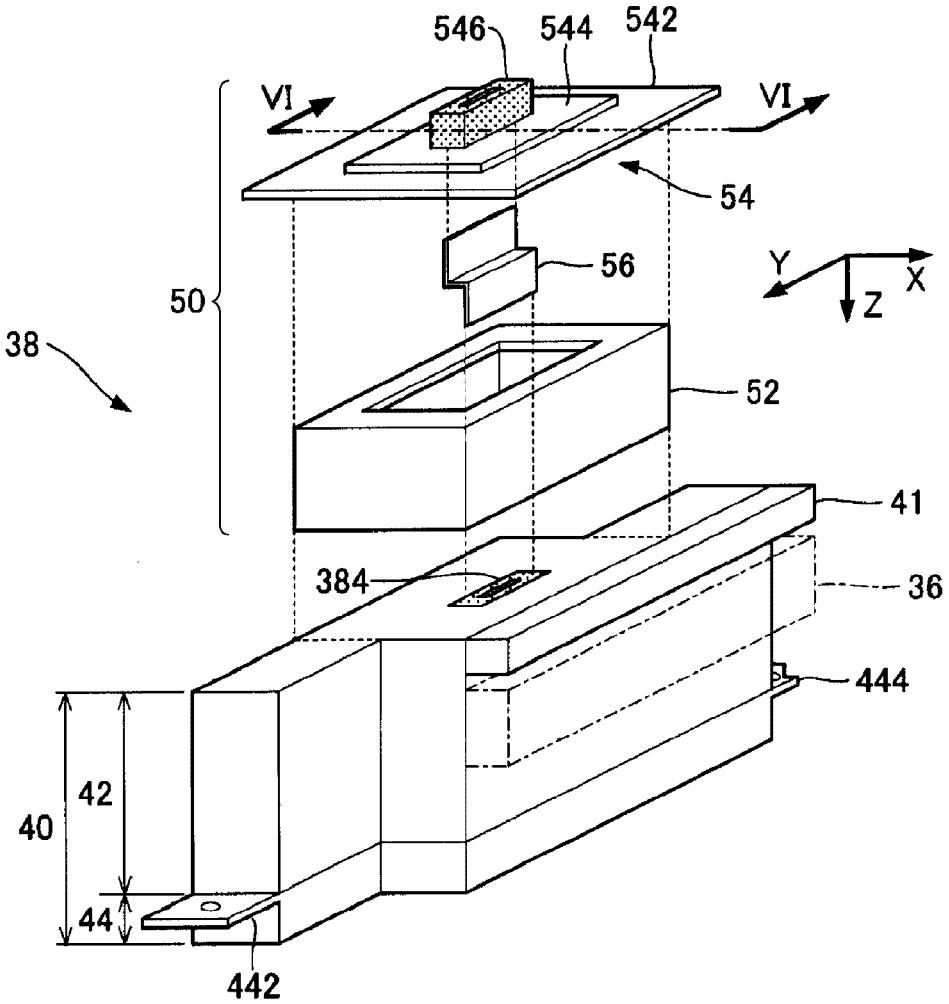
FIG. 5 is an exploded perspective view of a liquid ejecting module.

FIG. 5 is an exploded perspective view of any one liquid ejecting module 38. As illustrated in FIG. 5, the liquid ejecting module 38 of the first embodiment includes a liquid ejecting unit 40, a linking unit 50, and a transmission line 56. The liquid ejecting unit 40 ejects, to the medium 12, inks supplied from the liquid container 14 via the flow-path component 36. The liquid ejecting unit 40 of the first embodiment 1 includes a valve mechanism unit 41, a flow-path unit 42, and a liquid ejecting portion 44. The valve mechanism unit 41 includes a valve mechanism that controls opening and closing of flow paths of the inks which are supplied from the flow-path components 36. Note that the valve mechanism unit 41 is omitted in FIG. 2 for convenience. As illustrated in FIG. 5, the valve mechanism unit 41 of the first embodiment is disposed to overhang from a side surface of the liquid ejecting unit 40 in the X direction. On the other hand, the flow-path component 36 is disposed on the first support member 242 so as to face the side surface of the liquid ejecting unit 40. Hence, the top surfaces of the flow-path components 36 and the undersides of the valve mechanism units 41 face each other at intervals in the Z direction. In the configuration described above, a flow path in the flow-path component 36 and a flow path in the valve mechanism unit 41 communicate with each other.

The liquid ejecting portion 44 of the liquid ejecting unit 40 ejects inks from a plurality of nozzles. The flow-path unit 42 has a structure inside which a flow path through which an ink via the value mechanism unit 41 is supplied to the liquid ejecting portion 44 is formed. A connecting portion 384, which electrically connects the liquid ejecting unit 40 to the drive substrate 326 of the connecting unit 32, is disposed on the top surface of the liquid ejecting unit 40 (specifically, on the top surface of the flow-path unit 42). The linking unit 50 has a structure through which the liquid ejecting unit 40 is linked to the second support member 34. The transmission line 56 in FIG. 5 is a flexible cable such as a flexible flat cable (FFC) or flexible printed circuits (FPC).

Figure 6:
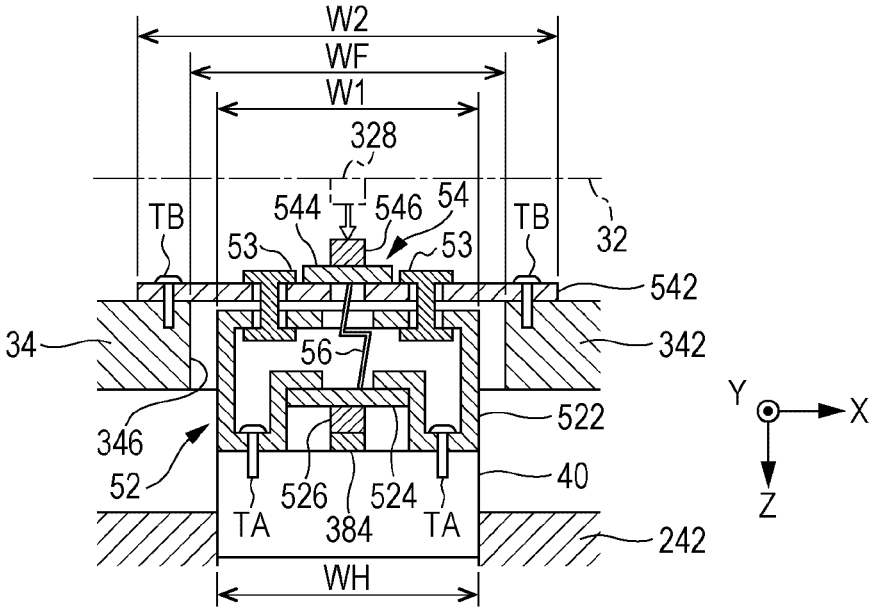
FIG. 6 is a sectional view of the liquid ejecting module (a sectional view taken along line VI-VI in FIG. 5).

FIG. 6 is a sectional view taken along line VI-VI in FIG. 5. As illustrated in FIGS. 5 and 6, the linking unit 50 of the first embodiment includes a first relay member 52 and a second relay member 54.

The first relay member 52 has a structure fixed to the liquid ejecting unit 40, and includes an accommodating member 522 and a wiring substrate 524 (an example of a second wiring substrate). The accommodating member 522 is a substantially box-shaped housing. As illustrated in FIG. 6, the liquid ejecting unit 40 is fixed to the accommodating member 522 on an underside (the positive side in the Z direction) with a fastener TA such as a screw. The wiring substrate 524 is a flat plate-shaped wiring substrate that configures the underside of the accommodating member 522. A connecting portion 526 (an example of a third connecting portion) is disposed on a front surface of the wiring substrate 524 on the liquid ejecting unit 40. The connecting portion 526 is a connector (board to board connector) for an electrical connection. In a state in which the first relay member 52 is fixed to the liquid ejecting unit 40, the connecting portion 526 of the wiring substrate 524 is detachably linked to the connecting portion 384 of the liquid ejecting unit 40.

The second relay member 54 has a structure for fixing the liquid ejecting module 38 to the second support member 34 and for electrically connecting the liquid ejecting module to the drive substrate 326, and includes an attaching substrate 542 and a wiring substrate 544 (an example of a first wiring substrate). The attaching substrate 542 is a plate-shaped member that is fixed to the second support member 34. As illustrated in FIG. 6, the accommodating member 522 of the first relay member 52 and the attaching substrate 542 of the second relay member 54 are linked to each other by using a connector 53. The connector 53 is a pin molded to have both flange-shaped end portions of a cylindrical shaft and is inserted into a through-hole formed each of the first relay member 52 and the second relay member 54. A diameter of the shaft of the connector 53 is smaller than an inner diameter of the through-hole of each of the first relay member 52 and the second relay member 54. Hence, a gap is formed between an outer circumferential surface of the shaft of the connector 53 and an inner circumferential surface of the through-hole and the first relay member 52 and the second relay member 54 are linked in an unrestricted manner. In other words, one of the first relay member 52 or the second relay member 54 can move in the X-Y plane with respect to the other by a distance of a gap between the connector 53 and the through-hole.

As illustrated in FIG. 6, a dimension W2 of the second relay member 54 (attaching substrate 542) in the X direction is smaller than a dimension W1 of the first relay member 52 (accommodating member 522) in the X direction. Hence, edges positioned on both sides of the attaching substrate 542 in the X direction overhang from sides of the first relay member 52 to the positive side and the negative side in the X direction. The dimension W2 of the second relay member 54 is larger than a dimension WF of the opening 346 of the second support member 34 in the X direction (W2>WF). An overhanging portion of the attaching substrate 542 from the accommodating member 522 is fixed to the top surface of the support portion 342 in the second support member 34 by using fasteners TB (a plurality of screws in an example in FIG. 6). On the other hand, the dimension W1 of the first relay member 52 in the X direction is smaller than the dimension WF of the opening 346 of the second support member 34 (W1<WF). Hence, as illustrated in FIG. 6, a gap is formed between an outer wall surface of the first relay member 52 (accommodating member 522) and an inner wall surface of the opening 346 of the second support member 34. In other words, before installation is performed in the second support member 34, the first relay member 52 is able to pass through the opening 346 of the second support member 34. As understood in the above description, since the second relay member 54 is fixed to the second support member 34 and the first relay member 52 is linked to the second relay member 54 in the unrestricted manner, the second relay member 54 is able to move with respect to the second support member 34 in the X-Y plane.

The wiring substrate 544 is a plate-shaped member fixed to a front surface of the attaching substrate 542 on a side opposite to the first relay member 52. A connecting portion 546 (an example of a first connecting portion) is disposed on a front surface of the wiring substrate 544 on the connecting unit 32 side (negative side in the Z direction). In other words, the connecting portion 546 is fixed to the second support member 34 via the wiring substrate 544 and the attaching substrate 542. The connecting portion 546 is a connector (board to board connector) for an electrical connection. Specifically, in a state in which the second support member 34 is fixed to the connecting unit 32, the connecting portion 546 of the wiring substrate 544 is detachably linked to the connecting portion 328 of the connecting unit 32. In other words, the connecting portion 328 of the connecting unit 32 is attachable to and detachable from the connecting portion 546 through a side (negative side in the Z direction) opposite to the liquid ejecting unit 40.

As illustrated in FIG. 6, the transmission line 56 is provided over the wiring substrate 544 and the wiring substrate 524 so as to electrically connect the connecting portion 546 and the connecting portion 526. As illustrated in FIGS. 5 and 6, the transmission line 56 is accommodated in the accommodating member 522 in a state of being bent along a straight line parallel to the X direction between the connecting portion 546 and the connecting portion 526. One end of the transmission line 56 is joined to a surface of the wiring substrate 544, which faces the wiring substrate 524, and is electrically connected to the connecting portion 546, and the other end of the transmission line 56 is joined to a surface of the wiring substrate 524, which faces the wiring substrate 544, and is electrically connected to the connecting portion 526.

As understood in the above description, the drive substrate 326 of the connecting unit 32 is electrically connected to the connecting portion 384 of the liquid ejecting unit 40 via the connecting portion 328, the connecting portion 546, the wiring substrate 544, the transmission line 56, the wiring substrate 524, and the connecting portion 526. Hence, a power-supply voltage and an electrical signal (drive signal and control signal) generated in the drive substrate 326 are supplied to the liquid ejecting unit 40 via the connecting portion 328, the connecting portion 546, the transmission line 56, and the connecting portion 526.

For example, in a case where the connecting portions 546 are positioned depending on relative relationships between the plurality of connecting portions 546, and the liquid ejecting units 40 are positioned depending on relative relationships between the plurality of liquid ejecting units 40, a positional error can be produced between the connecting portion 546 and the liquid ejecting unit 40. In the first embodiment, since the transmission line 56 is a flexible member so as to be easily deformed, the deformation of the transmission line 56 absorbs the positional error between the connecting portion 546 and the liquid ejecting unit 40. In other words, the transmission line 56 of the first embodiment functions as a connecting member that links the connecting portion 546 to the liquid ejecting unit 40 so as to absorb the positional error between the connecting portion 546 and the liquid ejecting unit 40.

In the configuration described above, in a process of attaching and detaching the connecting portion 328 of the connecting unit 32 to and from the connecting portion 546, a stress acting on the liquid ejecting unit 40 from the connecting portion 546 is reduced. Hence, without consideration of the stress acting on the liquid ejecting unit 40 (eventually, a positional shift of the liquid ejecting unit 40) from the connecting portion 546, it is possible to easily assemble or disassemble the liquid ejecting head 24. In the first embodiment, since the transmission line 56 is bent between the connecting portion 546 and the liquid ejecting unit 40, the following effect is remarkably achieved. It is possible to absorb the positional error between the connecting portion 546 and the liquid ejecting unit 40.

Figure 7:
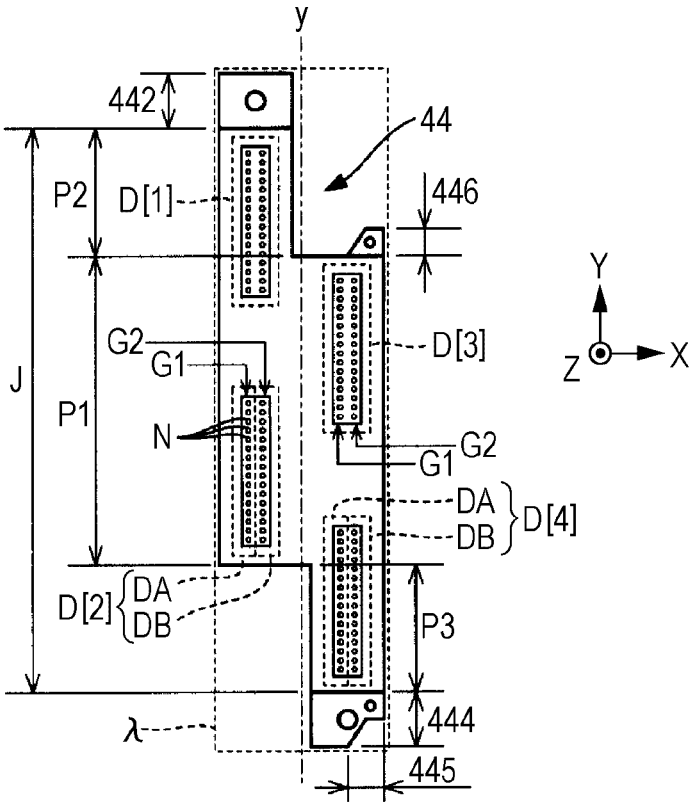
FIG. 7 is a plan view of an ejecting surface.

FIG. 7 is a plan view of a front surface of the liquid ejecting portion 44 which faces the medium 12 (that is, a plan view of the liquid ejecting portion 44 when viewed from the positive side in the Z direction). As illustrated in FIG. 7, a plurality of nozzles (ejecting holes) N are formed in the surface (hereinafter, referred to as an "ejection surface") of the liquid ejecting portion 44 which faces the medium 12. As illustrated in FIG. 7, the liquid ejecting portion 44 of the first embodiment includes four drive portions D[1] to D[4] that has the plurality of nozzles N formed in the ejection surface J. Ranges, in which the plurality of nozzles N are arranged, partially overlap each other in the Y direction between two drive portions D[n] (n=1 to 4).

As illustrated in FIG. 7, the plurality of nozzles N corresponding to any one drive portion D[n] are divided into a first array G1 and a second array G2. The first array G1 and the second array G2 are sets of the plurality of nozzles N arranged in the Y direction, respectively. The first array G1 and the second array G2 are arranged side by side in the X direction with an interval from each other. The drive portions D[n] include a first ejecting portion DA that ejects inks from the nozzles N of the first array G1 and a second ejecting portion DB that ejects inks from the nozzles N of the second array G2. Note that it is possible for the nozzles N of the first array G1 and the nozzles N of the second array G2 to have positions different in the Y direction (a so-called zigzag arrangement or a staggered arrangement). In addition, the number of the drive portions D[n] that are disposed in the liquid ejecting portion 44 is not limited to four.

As illustrated in FIG. 7, when a rectangle γ having the minimum area including the ejection surface J is assumed, it is possible to set a center line y parallel to a long side (in the Y direction) of the rectangle γ. As illustrated in FIG. 7, the ejection surface j in the first embodiment has a planar shape that are formed by connecting a first region P1, a second region P2, and a third region P3, in the Y direction (that is, a direction of the long side of the rectangle γ). The second region P2 is positioned on the positive side in the Y direction when viewed from the first region P1, and the third region P3 is positioned on a side (negative side in the Y direction) opposite to the second region P2 with the first region P1 interposed therebetween. As understood in FIG. 7, the first region P1 passes through the center line y of the rectangle X, but the second region P2 and the third region P3 do not pass through the center line y, either. Specifically, the second region P2 is positioned on the negative side in the X direction when viewed from the center line y, and the third region P3 is positioned on the positive side in the X direction when viewed from the center line y. In other words, the second region P2 and the third region P3 are positioned on the opposite sides from each other with the center line y interposed therebetween. It is possible to describe the planar shape of the ejection surface J as a shape in which the second region P2 is connected to an edge side of the first region P1 on the negative side in the X direction and the third region P3 is connected to an edge side of the first region P1 on the positive side in the X direction.

As illustrated in FIGS. 5 and 7, an overhang 442 and an overhang 444 are formed on an end surface of the liquid ejecting portion 44. The overhang 442 is a flat plate-shaped portion that overhangs from the end surface of the liquid ejecting portion 44 in an end portion of the second region P2 on a side (positive side in the Y direction) opposite to the first region P1. On the other hand, the overhang 444 is a flat plate-shaped portion that overhangs from the end surface of the liquid ejecting portion 44 in an end portion of the third region P3 on a side (negative side in the Y direction) opposite to the first region P1. In addition, as illustrated in FIG. 7, a projecting portion 446 is formed on an edge side (edge side on which the second region P2 does not exist) of the first region p1 on the second region P2 side. The projecting portion 446 is a flat plate-shaped portion (an example of a first overhang) that projects from a side surface of the liquid ejecting portion 44, similar to the overhang 442 and the overhang 444. A notch 445 having a shape corresponding to the projecting portion 446 is formed in the overhang 444 (example of a second overhang).

Figure 8:
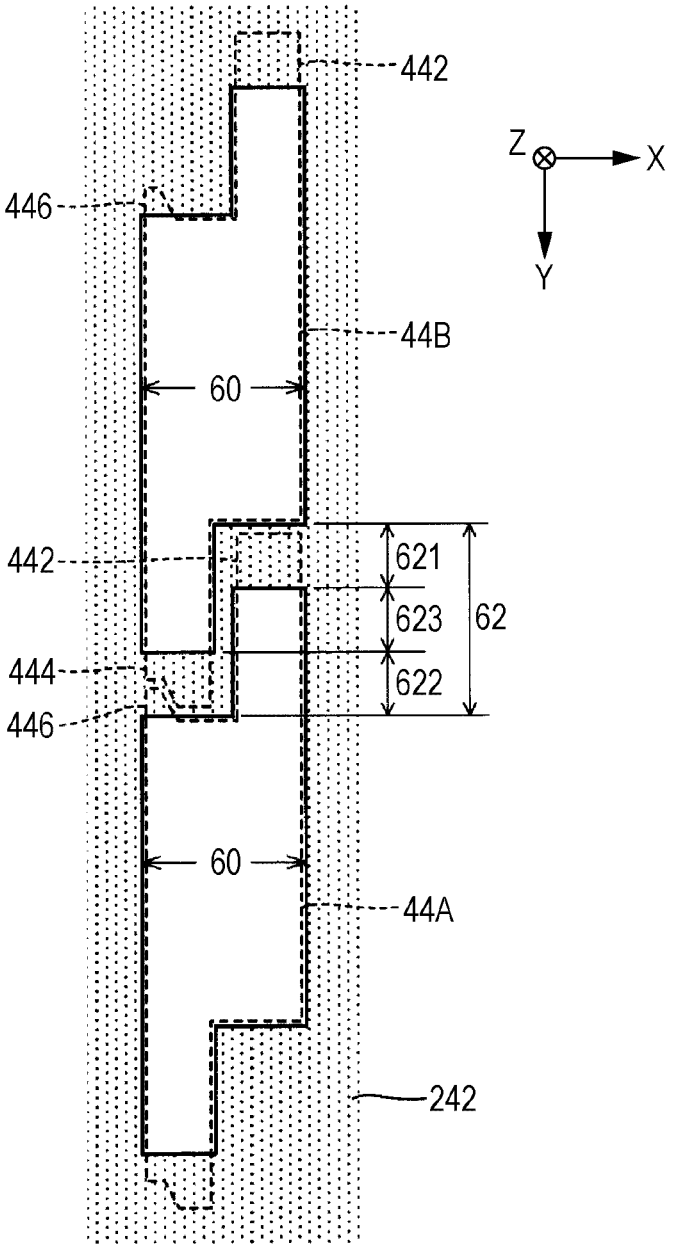
FIG. 8 is a plan view of a first support member.
Figure 9:
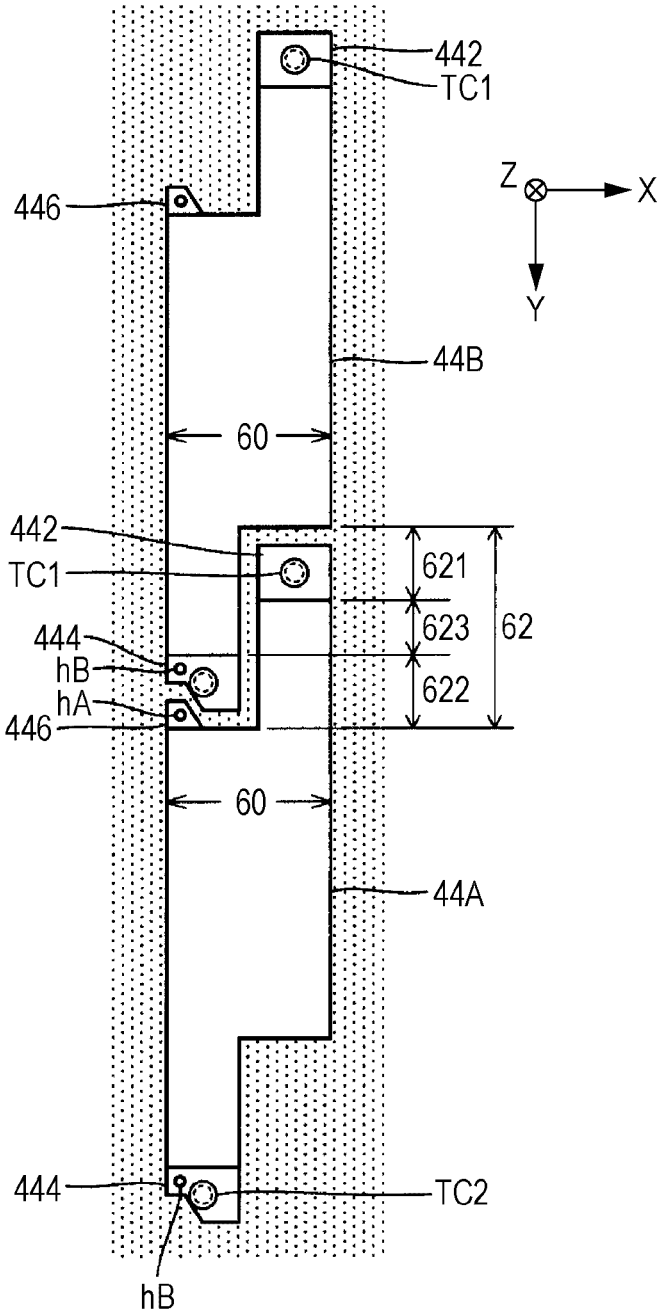
FIG. 9 is a view illustrating a state in which a plurality of liquid ejecting units are fixed to the first support member.

FIG. 8 is a plan view of a front surface (front surface on the negative side in the Z direction) of the first support member 242. FIG. 9 is a plan view in which the liquid ejecting portion 44 is added to FIG. 8. FIGS. 8 and 9 simply illustrate a range in which two liquid ejecting portions 44 (44A and 44B) are positioned to be adjacent in the Y direction. As illustrated in FIGS. 8 and 9, openings 60 corresponding to the liquid ejecting portions 44 (liquid ejecting modules 38) are formed in the first support member 242. Specifically, as understood in FIG. 2, six openings 60 corresponding to the liquid ejecting portions 44 are formed for each assembly 244 and are arranged in the Y direction so as to correspond to an arrangement of the plurality of assemblies 244. As illustrated in FIGS. 8 and 9, the opening 60 is a through-hole having a planar shape corresponding to an external shape of the ejection surface J of the liquid ejecting portion 44. The liquid ejecting units 40 are fixed to the first support member 242 in a state in which the liquid ejecting portions 44 are inserted into the openings 60 of the first support member 242. In other words, the ejection surface J of the liquid ejecting portion 44 is exposed on an inner side of the opening 60 from the first support member 242 on the positive side in the Z direction.

As illustrated in FIGS. 8 and 9, beam-shaped portions 62 are formed between two openings 60 adjacent in the Y direction. Any one beam-shaped portion 62 is formed by connecting a first support portion 621, a second support portion 622, and an intermediate portion 623, to each other. The first support portion 621 is a portion of the beam-shaped portion 62 which is positioned on the positive side in the X direction, and the second support portion 622 is a portion of the beam-shaped portion 62 which is positioned on the negative side in the X direction. The intermediate portion 623 connects the first support portion 621 and the second support portion 622.

As understood in FIG. 9, the overhangs 442 of the liquid ejecting portions 44 overlap the first support portions 621 of the beam-shaped portions 62 in a plan view (that is, a view in a direction parallel to the Z direction), and the overhangs 444 of the liquid ejecting portions 44 overlap the second support portions 622 of the beam-shaped portions 62 in the plan view. Thus, the overhang 442 is fixed to the first support portion 621 with a fastener TC1 and the overhang 444 is fixed to the second support portion 622 with a fastener TC2. In this manner, the liquid ejecting portion 44 is fixed to the first support member 242. For example, the fastener TC1 and the fastener TC2 are screws. As described above, since the liquid ejecting portion 44 (liquid ejecting unit 40) is fixed to the first support member 242 in both end portions of the ejection surface j, it is possible to effectively reduce an amount of a tilt of the liquid ejecting portion 44 with respect to the first support member 242. As illustrated in FIG. 9, when attention is paid to the opening 60 corresponding to the liquid ejecting portion 44A and the opening 60 corresponding to the liquid ejecting portion 44B, the overhang 442 of the liquid ejecting portion 44A is fixed to the first support portion 621 of the beam-shaped portion 62 between two openings and the overhang 444 of the liquid ejecting portion 44B is fixed to the second support portion 622 of the corresponding beam-shaped portion 62.

An engaging hole hA is formed in the projecting portion 446 of each of the liquid ejecting portion 44, and an engaging hole hB is formed with a through-hole, into which the fastener TC2 is inserted, in the overhang 444. The engaging hole hA and the engaging hole hB are through-holes (an example of a positioning portion) that engage with protrusions disposed on the front surface of the first support member 242. The protrusions on the front surface of the first support member 242 engage with the engaging hole hA and the engaging hole hB, respectively, and thereby the liquid ejecting portion 44 is reliably positioned in the X-Y plane. In other words, the liquid ejecting portion 44 is positioned in the first support member 242. As illustrated in FIG. 9, the engaging hole hA of the projecting portion 446 and the engaging hole hB of the overhang 444 are positioned on a straight line parallel to the Y direction (center line y). Hence, the following advantages are achieved. The amount of tilt of the liquid ejecting portion 44 (liquid ejecting unit 40) is reduced, and it is possible to position the corresponding liquid ejecting portion 44 in the first support member 242 with high accuracy. Note that the protrusions formed on the overhang 444 and the projecting portion 446 engage with the engaging holes (bottomed holes or through-holes) in the front surface of the first support member 242, and thereby it is possible to position the liquid ejecting portion 44 in the first support member 242.

Figure 10:
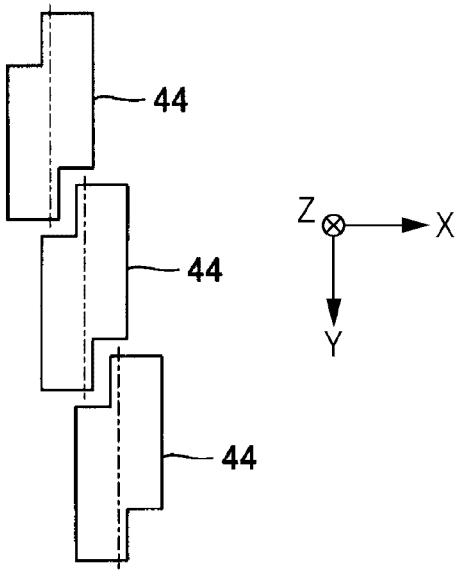
FIG. 10 is a view illustrating a comparative example.

As described above, in the first embodiment, since the beam-shaped portion 62 is formed between two openings 60 adjacent in the Y direction, the following advantage is achieved. It is possible to decrease the size of the first support member 242 in the X direction. In addition, in the first embodiment, since the intermediate portion 623 is formed in the beam-shaped portion 62, it is possible to maintain a mechanical strength of the first support member 242, compared to a configuration (configuration in which the beam-shaped portion 62 is not formed) in which the openings 60, through which the ejection surfaces J of the liquid ejecting portions 44 are exposed, are continuous over the plurality of liquid ejecting portions 44. Incidentally, in a configuration (hereinafter, referred to as a "comparative example") in which the second region P2 and the third region P3 of the ejection surface J pass through the center line y, the liquid ejecting portions 44 need to be arranged at different positions in the X direction, as illustrated in FIG. 10, in order to arrange the plurality of liquid ejecting portions 44 at sufficiently close positions to each other in the Y direction. In the first embodiment, since the second region P2 and the third region P3 do not pass through the center line y, it is possible to arrange the plurality of liquid ejecting portions 44 in a straight line shape in the Y direction, as illustrated in FIG. 9. Hence, an advantage is achieved in that it is possible to decrease the liquid ejecting head 24 (one assembly 244) in size in a width direction, compared to the comparative example.

Figure 11:
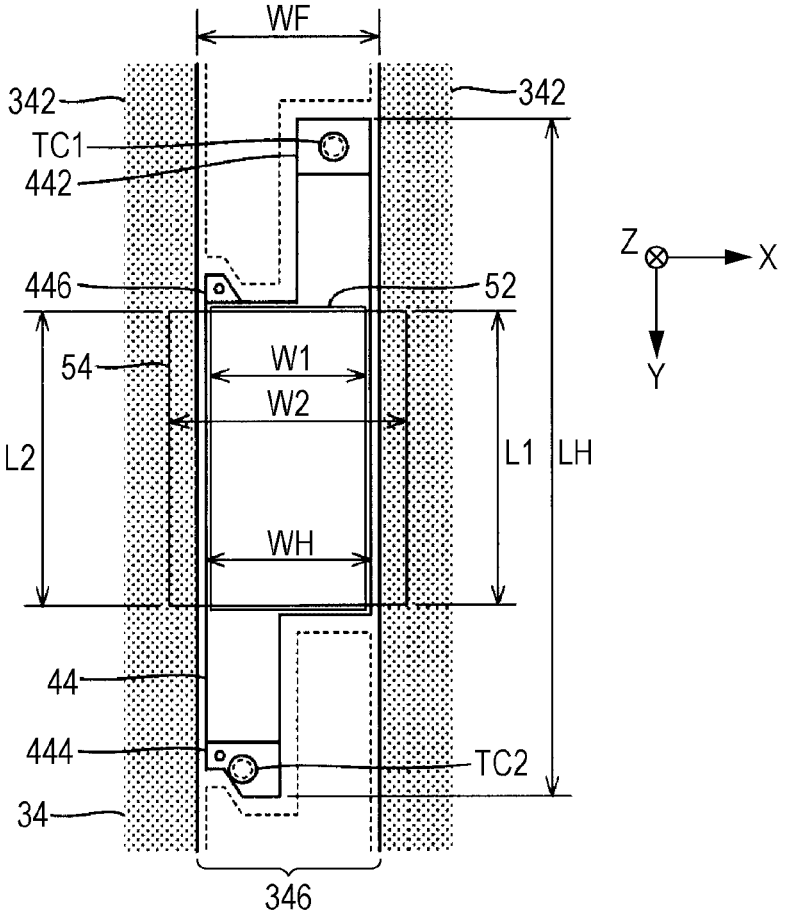
FIG. 11 is a view illustrating a relationship between an opening of the second support member and the liquid ejecting module.

FIG. 11 is a plan view illustrating a relationship between the liquid ejecting unit 40, the linking unit 50, and the second support member 34. As illustrated in FIG. 11, a dimension WH of the liquid ejecting unit 40 in the X direction is smaller than the dimension WF of the opening 346 of the second support member 34 (WH<WF). As described above with reference to FIG. 6, since the dimension W1 of the first relay member 52 is smaller than the dimension WF of the opening 346, the liquid ejecting unit 40 and the first relay member 52 are able to pass through the opening 346 of the second support member 34. As described above, since it is possible to attach and detach the liquid ejecting unit 40 and the second relay member 54 through the opening 346 of the second support member 34, it is possible to decrease a burden of assembly and disassembly of the liquid ejecting head 24 according to the first embodiment.

As illustrated in FIG. 11, a dimension L1 of the first relay member 52 and a dimension L2 of the second relay member 54 in the Y direction are smaller than a dimension LH of the liquid ejecting unit 40 in the Y direction (L1<LH and L2<LH). Hence, in a state in which outer wall surfaces of the first relay member 52 on both sides in the Y direction are gripped by fingers, it is possible to easily attach and detach the liquid ejecting module 38 to and from the second support member 34. In addition, as illustrated in FIG. 11, the first relay member 52 and the second relay member 54 are not overlapped, in a plan view, with the fastener TC1 and the fastener TC2 for fixing the liquid ejecting unit 40 to the first support member 242. Hence, an advantage is achieved in that the liquid ejecting unit 40 is easily fixed to the first support member 242 with the fastener TC1 and the fastener TC2.

Figure 12:
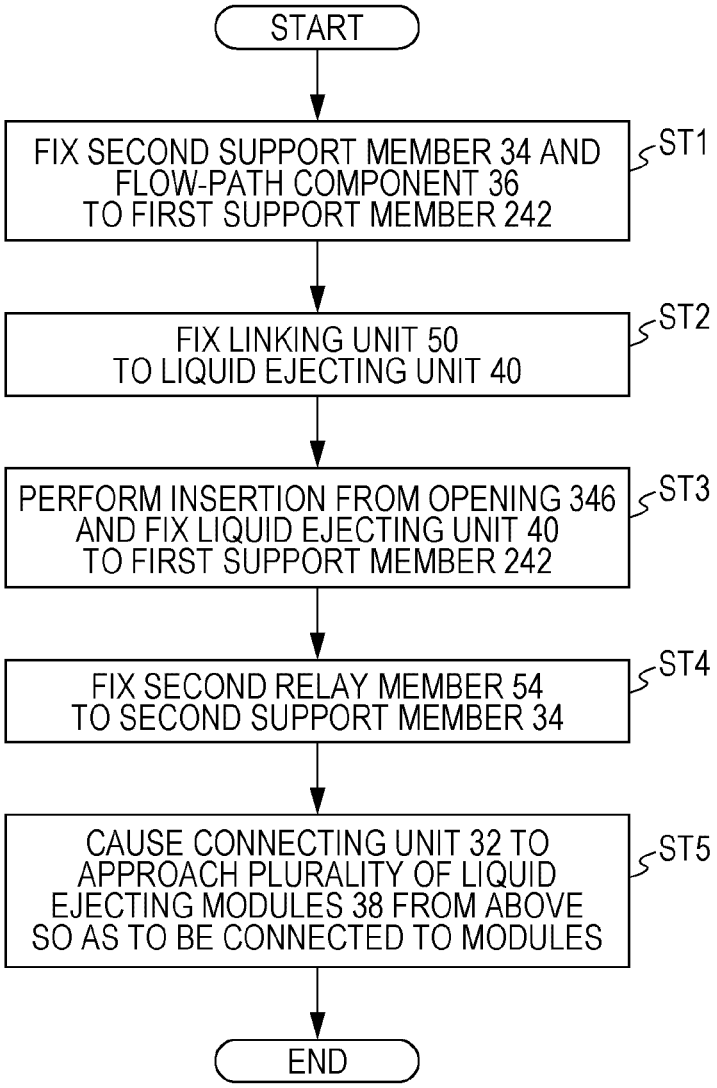
FIG. 12 is a flowchart of a method for manufacturing the liquid ejecting head.

FIG. 12 is a flowchart of a method for manufacturing the liquid ejecting head 24. As illustrated in FIG. 12, first, the second support member 34 and the flow-path component 36 are fixed to the first support member 242 (ST1). On the other hand, the linking unit 50 is fixed to the liquid ejecting unit 40 by using a fastener TA, and thereby the liquid ejecting module 38 is assembled (ST2). Note that it is possible to perform Step ST2 before Step ST1 is performed.

In Step ST3 after Step ST1 and Step ST2 are performed, in each of the plurality of liquid ejecting modules 38, the liquid ejecting module 38 is inserted into the opening 346 of the second support member 34 from the side opposite to the first support member 242, and the liquid ejecting unit 40 is fixed to the first support member 242 by using the fastener TC1 and the fastener TC2 (ST3). In the process of inserting the liquid ejecting module 38 into the opening 346 and causing the liquid ejecting module to approach the first support member 242, the valve mechanism unit 41 and the flow-path component 36 communicate with each other. In Step ST4 after Step St3 is performed, in each of the plurality of liquid ejecting modules 38, the second relay member 54 of the linking unit 50 is fixed to the second support member 34 by using the fastener TB. Note that it is possible to perform Step ST4 before Step ST3 is performed.

In Step ST5 after Step ST3 and Step ST4 are performed, the connecting units 32 are caused to approach the liquid ejecting modules 38 from the side (negative side in the Z direction) opposite to the liquid ejecting unit 40 with the linking unit 50 interposed therebetween. In the plurality of liquid ejecting modules 38, the connecting portions 546 and the connecting portions 328 of the connecting unit 32 are detachably connected to each other in a collective manner.

Through Steps (ST1 to ST5) above, one assembly 244 including the connecting unit 32, the second support member 34, the flow-path component 36, and the plurality of liquid ejecting modules 38 is installed in the first support member 242. The same steps are repeated and the plurality of assemblies 244 are fixed to the first support member 242. In this manner, the liquid ejecting head 24 in FIG. 2 is manufactured.

As understood in the above description, Step ST3 is the process of fixing the liquid ejecting unit 40 to the first support member 242, and Step ST4 is the process of fixing the linking unit 50 to the second support member 34. In addition, Step ST 5 is the process of causing the connecting unit 32 to approach the plurality of liquid ejecting modules 38, and thereby detachably connecting the connecting portion 546 and the connecting portion 328. However, the method for manufacturing the liquid ejecting head 24 is not limited to the method described above.

Figure 13:
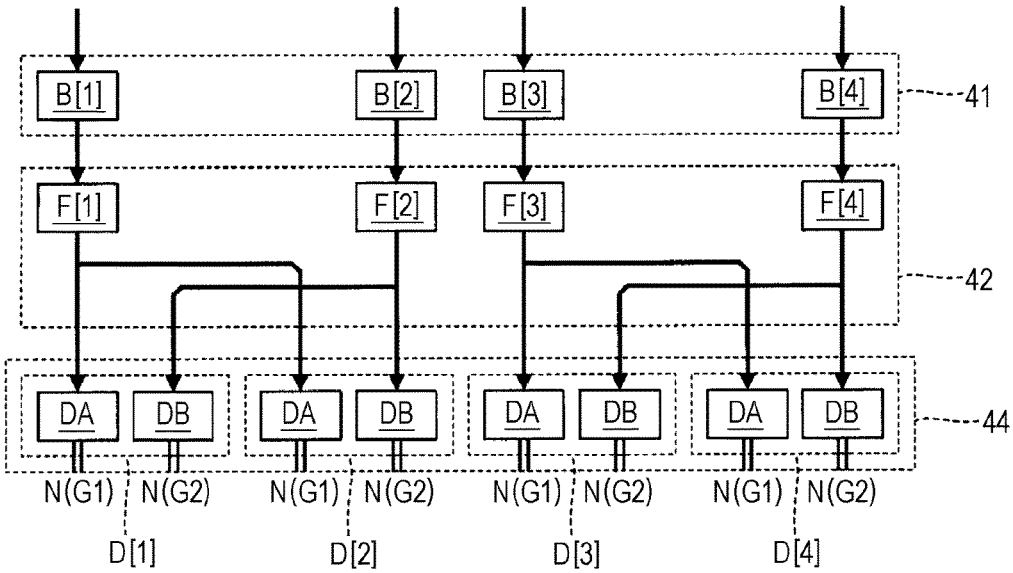
FIG. 13 is a diagram illustrating a flow path through which an ink is supplied to a liquid ejecting portion.

A specific configuration of the liquid ejecting unit 40 described above is described. FIG. 13 is a diagram illustrating a flow path through which an ink is supplied to the liquid ejecting unit 40. As described above with reference to FIG. 5, the liquid ejecting portion 44 of the liquid ejecting unit 40 includes four drive portions D[1] to D[4]. The drive portions D[n] include the first ejecting portion DA that ejects inks from the nozzles N of the first array G1 and the second ejecting portion DB that ejects inks from the nozzles N of the second array G2. As illustrated in FIG. 13, the valve mechanism unit 41 includes four on-off valves B[1] to B[4], and the flow-path unit 42 of the liquid ejecting unit 40 includes four filters F[1] to F[4]. The on-off valve B[n] is a valve mechanism that opens and closes the flow path through which the ink is supplied to the liquid ejecting portion 44. The filter F[n] collects bubbles or foreign substances mixed in the ink in the flow path.

As illustrated in FIG. 13, after an ink passes through the on-off valve B[1] and the filter F[1], the ink is supplied to the first ejecting portions DA of the drive portion D[1] and the drive portion D[2]. After an ink passes through the on-off valve B[2] and the filter F[2], the ink is supplied to the second ejecting portions DB of the drive portion D[1] and the drive portion D[2]. Similarly, after an ink passes through the on-off valve B[3] and the filter F[3], the ink is supplied to the first ejecting portions DA of the drive portion D[3] and the drive portion D[4]. In addition, after an ink passes through the on-off valve B[4] and the filter F[4], the ink is supplied to the second ejecting portions DB of the drive portion D[3] and the drive portion D[4]. In other words, inks are ejected from the nozzles N of the first array G1 after the inks pass through the on-off valve B[1] or the on-off valve B[3], and the inks are ejected from the nozzles N of the second array G2 after the inks pass through the on-off valve B[2] or the on-off valve B[4].

Figure 14:
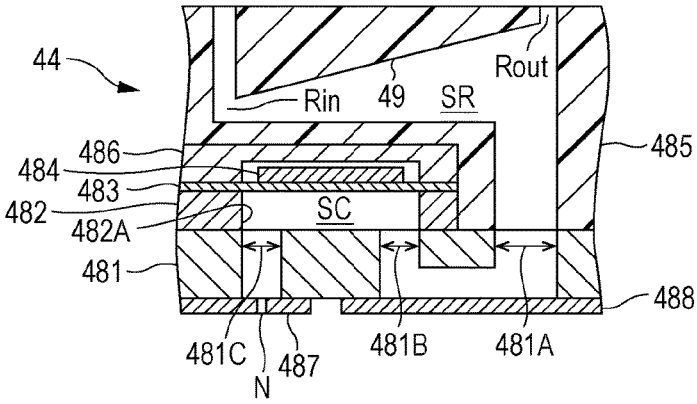
FIG. 14 is a sectional view of the liquid ejecting portion.

FIG. 14 is a sectional view illustrating a portion of the liquid ejecting portion 44 (the first ejecting portion DA or the second ejecting portion DB) which corresponds to any one nozzle N. As illustrated in FIG. 14, the liquid ejecting portion 44 of the first embodiment has a structure in which a pressure-chamber substrate 482, a vibration plate 483, a piezoelectric element 484, a housing portion 485, and a seal member 486 are disposed on one side of the flow-path substrate 481, and a nozzle-formed plate 487 and a shock-absorbing plate 488 are disposed on the other side thereof. The flow-path substrate 481, the pressure-chamber substrate 482, and the nozzle-formed plate 487 are formed of, for example, a flat silicon plate and the housing portion 485 is formed of, for example, a resin material through an injection molding. The plurality of nozzles N is formed in the nozzle-formed plate 487. A front surface of the nozzle-formed plate 487 on a side opposite to the flow-path substrate 481 corresponds to the ejection surface J.

An opening 481A, a diverging flow path (narrowed flow path) 481B, and a communicating flow path 481C are formed in the flow-path substrate 481. The diverging flow path 481B and the communicating flow path 481C are through-holes formed for each nozzle N, and the opening 481A is an opening that is continuous over the plurality of nozzles N. The shock-absorbing plate 488 is a flat plate (compliance substrate) is disposed on a front surface of the flow-path substrate 481 on a side opposite to the pressure-chamber substrate 482 and closes the opening 481A. The shock-absorbing plate 488 absorbs a pressure change in the opening 481A.

A common liquid chamber (reservoir) SR that communicates with the opening 481A of the flow-path substrate 481 is formed in the housing portion 485. The common liquid chamber SR is a space that stores an ink that is supplied to the plurality of nozzles N which configure one of the first array G1 or the second array G2, and that is continuous over the plurality of nozzles N. An inlet Rin, through which an ink supplied from an upstream side flows in, is formed in a common liquid chamber SR.

An opening 482A is formed in the pressure-chamber substrate 482 for each nozzle N. The vibration plate 483 is an elastically deformable flat plate disposed on a front surface of the pressure-chamber substrate 482 on a side opposite to the flow-path substrate 481. A space interposed between the vibration plate 483 and the flow-path substrate 481 on the inner side of each of the openings 482A of the pressure-chamber substrate 482 functions as a pressure chamber (cavity) SC that is filled with an ink which is supplied from the common liquid chamber SR via the diverging flow path 481B. The pressure chambers SC communicate with the nozzles N via the communicating flow path 481C of the flow-path substrate 481.

The piezoelectric element 484 is formed for each nozzle N on a front surface of the vibration plate 483 on a side opposite to the pressure-chamber substrate 482. The piezoelectric elements 484 are drive elements in which a piezoelectric body is interposed between electrodes that face each other. When the piezoelectric element 484 is deformed in response to the supply of the drive signal, and thereby the vibration plate 483 vibrates, a pressure in the pressure chamber SC changes, and the ink in the pressure chamber SC is ejected through the nozzle N. The seal member 486 protects the plurality of piezoelectric elements 484.

Figure 15:
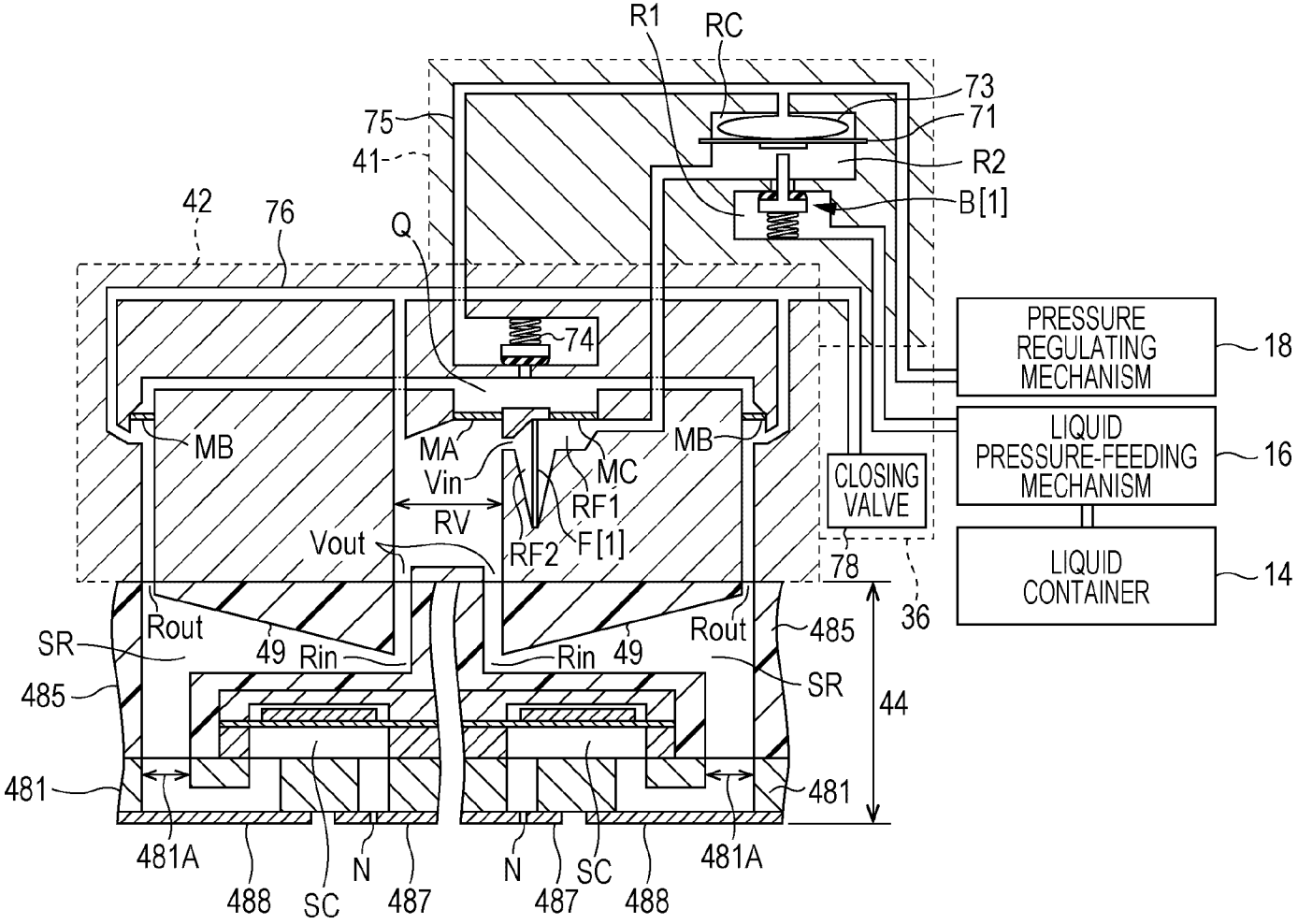
FIG. 15 is a diagram illustrating an internal flow path of the liquid ejecting unit.

FIG. 15 is a diagram illustrating an internal flow path of the liquid ejecting unit 40. FIG. 15 illustrates examples of flow paths through which the inks are supplied to the first ejecting portions DA of the drive portion D[1] and the drive portion D[2] through the on-off valve B[1] and the filter F[1], for convenience, and the other flow path described above with reference to FIG. 13 has the same configuration. The valve mechanism unit 41, the flow-path unit 42, and the housing portion 485 of the liquid ejecting portion 44 function as flow-path structures that configure the internal flow paths for supplying inks to the nozzles N.

Figure 16:
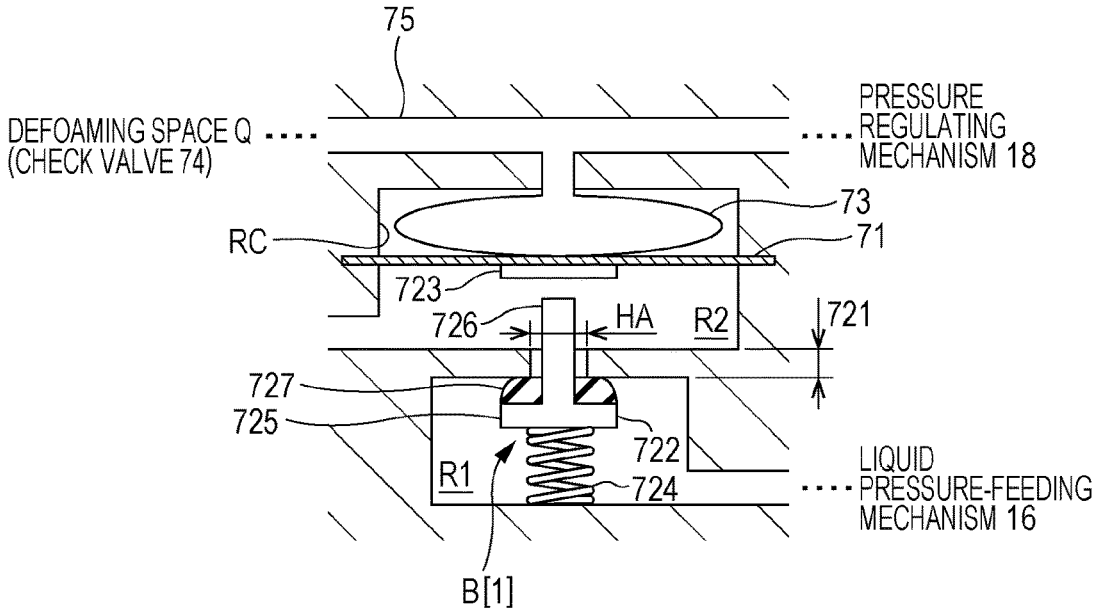
FIG. 16 is a diagram of a configuration of an on-off valve of a valve mechanism unit.

FIG. 16 is a diagram focusing on the inside of the valve mechanism unit 41. As illustrated in FIGS. 15 and 16, a space R1, a space R2, and a control chamber RC are formed inside the valve mechanism unit 41. The space R1 is connected to a liquid pressure-feeding mechanism 16 via the flow-path component 36. The liquid pressure-feeding mechanism 16 supplies (that is, feeds) inks in a pressurized state, which is stored in the liquid container 14, to the liquid ejecting unit 40. The on-off valve B[1] is disposed between the space R1 and the space R2, and a movable membrane 71 is interposed between the space R2 and the control chamber RC. As illustrated in FIG. 16, the on-off valve B[1] includes a valve seat 721, a valve body 722, a pressure receiving plate 723, and a spring 724. The valve seat 721 is a flat plate-shaped portion by which the space R1 and the space R2 are partitioned. A communicating hole HA through which the space R1 communicates with the space R2 is formed in the valve seat 721. The pressure receiving plate 723 is a substantially circular flat plate disposed on a surface of the movable membrane 71 which faces the valve seat 721.

The valve body 722 of the first embodiment includes a base portion 725, a valve shaft 726, and a seal portion (seal) 727. The valve shaft 726 projects vertically from a front surface of the base portion 725, and the annular seal portion 727 that surrounds the valve shaft 726 in a plan view is disposed on the front surface of the base portion 725. The valve body 722 is disposed in the space R1 in a state in which the valve shaft 726 is inserted into the communicating hole HA, and the valve body is biased to the valve seat 721 side by the spring 724. A gap is formed between an outer circumferential surface of the valve shaft 726 and an inner circumferential surface of the communicating hole HA.

As illustrated in FIG. 16, a pouch-shaped member 73 is disposed in the control chamber RC. The pouch-shaped member 73 is formed of an elastic material such as rubber, and is inflated in response to pressurization of an inner space and is deflated in response to depressurization of the inner space. As illustrated in FIG. 15, the pouch-shaped member 73 is connected to the pressure regulating mechanism 18 via the flow path in the flow-path component 36. The pressure regulating mechanism 18 is capable of selectively perform a pressurizing operation of supplying air to the flow path connected to the pressure regulating mechanism 18 and a depressurizing operation of suction of air from the flow path in response to an instruction from the control unit 20. Air is supplied to the inner space from the pressure regulating mechanism 18 (that is, pressurization), and thereby the pouch-shaped member 73 is inflated. The pressure regulating mechanism 18 suctions air (that is, depressurization), and thereby the pouch-shaped member 73 is deflated.

In a case where the pressure in the space R2 is maintained within a predetermined range in the state in which the pouch-shaped member 73 is deflated, the spring 724 biases the valve body 722, and thereby the seal portion 727 comes into close contact with the front surface of the valve seat 721. Hence, the space R1 is blocked from the space R2. On the other hand, when the pressure in the space R2 is reduced to be lower than a predetermined threshold value due to ejection of the ink by the liquid ejecting portion 44 or suction of the ink from the outside, the movable membrane 71 is shifted to the valve seat 721 side, and thereby the pressure receiving plate 723 presses the valve shaft 726. Then, the valve body 722 moves against the bias by the spring 724, and thereby the seal portion 727 is separated from the valve seat 721. Hence, the space R1 and the space R2 communicate with each other via the communicating hole HA.

In addition, when the pressurization by the pressure regulating mechanism 18 causes the pouch-shaped member 73 to be inflated, the pouch-shaped member 73 performs pressing and the movable membrane 71 is shifted to the valve seat 721. Hence, the pressing by the pressure receiving plate 723 causes the valve body 722 to move and the on-off valve B[1] is opened. In other words, regardless of whether the pressure in the space R2 is high or low, the pressurization by the pressure regulating mechanism 18 forces the on-off valve B[1] to be opened.

As illustrated in FIG. 15, the flow-path unit 42 of the first embodiment includes a defoaming space Q, the filter F[1], a vertical space RV, and a check valve 74. The defoaming space Q is a space in which bubbles extracted from the inks stay temporarily.

The filter F[1] is disposed across the internal flow path for supplying the inks to the liquid ejecting portion 44, and collects bubbles or foreign substances mixed in the inks. Specifically, the filter F[1] is disposed, and thereby a space RF1 and a space RF2 are partitioned. The space RF1 on the upstream side communicates with the space R2 of the valve mechanism unit 41 and the space RF2 on the downstream side communicates with the vertical space RV.

A gas permeable membrane MC (an example of a second gas permeable membrane) is interposed between the space RF1 and the defoaming space Q. Specifically, a ceiling surface of the space RF1 is configured of the gas permeable membrane MC. The gas permeable membrane MC is a membrane (gas-liquid separating membrane) having a gas permeability through which gases (air) are permeable, but liquids such as ink are not permeable, and, for example, is formed of a known polymer material. The bubbles collected by the filter F[1] rise due to the buoyancy, reach the ceiling surface of the space RF1, are permeable through the gas permeable membrane MC, and are discharged to the defoaming space Q. In other words, the bubbles mixed in the inks are separated.

The vertical space RV is a space in which the inks stay temporarily. The vertical space RV of the first embodiment is provided with an inlet Vin through which the inks flow in from the space RF2 after passing through the filter F[1] and an outlet Vout through which the inks flow out to the nozzles N. In other words, the ink in the space RF2 flows in to the vertical space RV via the inlet Vin and the ink in the vertical space RV flows to the liquid ejecting portion 44 (the common liquid chamber SR) via the outlet Vout. As illustrated in FIG. 15, the inlet Vin is positioned above (the negative side in the Z direction) the outlet Vout in a vertical direction.

A gas permeable membrane MA (an example of a first gas permeable membrane) is interposed between the vertical space RV and the defoaming space Q. Specifically, a ceiling surface of the vertical space RV is configured of the gas permeable membrane MA. The gas permeable membrane MA is a membrane having the same gas permeability as the gas permeable membrane MC described above. Hence, bubbles approaching the vertical space RV having passed through the filter F[1] rise due to the buoyancy, are permeable through the gas permeable membrane MA of the ceiling surface of the vertical space RV, and are discharged to the defoaming space Q. As described above, since the inlet Vin is positioned above the outlet Vout in the vertical direction, the buoyance in the vertical space RV enables the bubbles to effectively reach the gas permeable membrane MA of the ceiling surface.

As described above, the inlet Rin, through which the ink supplied from the outlet Vout of the vertical space RV flows in, is formed in the common liquid chamber SR of the liquid ejecting portion 44. In other words, the ink flowing out from the outlet Vout of the vertical space RV flows into the common liquid chamber SR via the inlet Rin and is supplied to the pressure chambers SC via the openings 481A. In addition, a discharge port Rout is formed in the common liquid chamber SR of the first embodiment. The discharge port Rout is a flow path formed in a ceiling surface 49 of the common liquid chamber SR. As illustrated in FIG. 15, the ceiling surface 49 of the common liquid chamber SR is an inclined surface (a flat surface or a curved surface) which becomes higher from the inlet Rin side toward the discharge port Rout side. Hence, the bubbles entering from the inlet Rin are guided to the discharge port Rout along the ceiling surface 49 due to the action of the buoyance.

A gas permeable membrane MB (an example of the first gas permeable membrane) is interposed between the common liquid chamber SR and the defoaming space Q. The gas permeable membrane MB is a membrane having the same gas permeability as the gas permeable membrane MA and the gas permeable membrane MC. Hence, the bubbles approaching the discharge port Rout from the common liquid chamber SR rise due to the buoyancy, are permeable through the gas permeable membrane MB, and are discharged to the defoaming space Q. As described above, since the bubbles in the common liquid chamber SR are guided to the discharge port Rout along the ceiling surface 49, it is possible to effectively discharge the bubbles in the common liquid chamber SR, for example, compared to a configuration in which the ceiling surface 49 of the common liquid chamber SR is horizontal. It is possible to form the gas permeable membrane MA, the gas permeable membrane MB, and the gas permeable membrane MC of a single membrane.

As described above, in the first embodiment, the gas permeable membrane MA is interposed between the vertical space RV and the defoaming space Q, the gas permeable membrane MB is interposed between the common liquid chamber SR and the defoaming space Q, and the gas permeable membrane MC is interposed between the space RF1 and the defoaming space Q. In other words, bubbles that permeate through all of the gas permeable membrane MA, the gas permeable membrane MB, and the gas permeable membrane MC reach the common defoaming space Q. Hence, an advantage is achieved in that the structure for discharging the bubbles is simplified, compared to a configuration in which bubbles extracted from portions of the liquid ejecting unit 40 are supplied to separate spaces.

As illustrated in FIG. 15, the defoaming space Q communicates with a defoaming route 75. The defoaming route 75 is a route for discharging the air staying in the defoaming space Q to the outside of the apparatus. The check valve 74 is interposed between the defoaming space Q and the defoaming route 75. The check valve 74 is a valve mechanism that allows the air to flow from the defoaming space Q toward the defoaming route 75, but prevents the air from flowing from the defoaming route 75 toward the defoaming space Q.

Figure 17:
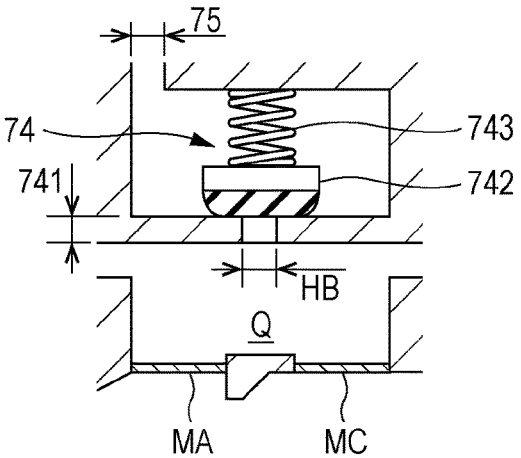
FIG. 17 is a diagram illustrating a defoaming space and a check valve.

FIG. 17 is a diagram focusing on the vicinity of the check valve 74 of the flow-path unit 42. As illustrated in FIG. 17, the check valve 74 of the first embodiment includes a valve seat 741, a valve body 742, and a spring 743. The valve seat 741 is a flat plate-shaped portion by which the defoaming space Q and the defoaming route 75 are partitioned. A communicating hole HB through which the defoaming space Q communicates with the defoaming route 75 is formed in the valve seat 741. The valve body 742 faces the valve seat 741 and is biased to the valve seat 741 by the spring 743. In a state in which a pressure in the defoaming route 75 is higher than a pressure in the defoaming space Q (a state in which the inside of the defoaming route 75 is opened to the atmosphere or is pressurized), the valve body 742 biased by the spring 743 comes into close contact with the valve seat 741, and thereby the communicating hole HB is closed. Hence, the defoaming space Q is blocked from the defoaming route 75. On the other hand, in a state in which the pressure in the defoaming route 75 is lower than the pressure in the defoaming space Q (a state in which the inside of the defoaming route 75 depressurizes), the valve body 742 is separated from the valve seat 741 against the spring 743. Hence, the defoaming space Q communicates with the defoaming route 75 via the communicating hole HB.

The defoaming route 75 of the first embodiment is connected to a route that connects the pressure regulating mechanism 18 and the control chamber RC of the valve mechanism unit 41. In other words, two systems diverge from the route connected to the pressure regulating mechanism 18. One is connected to the control chamber RC and the other is connected to the defoaming route 75.

As illustrated in FIG. 15, a discharge route 76 is formed to reach the inside of the flow-path component 36 from the liquid ejecting unit 40 through the valve mechanism unit 41. The discharge route 76 communicates with the internal flow path (specifically, a flow path for supplying the inks to the liquid ejecting portion 44) of the liquid ejecting unit 40. Specifically, the discharge route 76 communicates with the vertical space RV and the discharge ports Rout of the common liquid chambers SR of each of the liquid ejecting portions 44.

An end portion of the discharge route 76 on the side opposite to the liquid ejecting unit 40 is connected to the closing valve 78. The closing valve 78 may be positioned at any position, and a configuration in which the closing valve 78 is disposed in the flow-path component 36 is illustrated in FIG. 15. The closing valve 78 is a valve mechanism that can close (normally closes) the discharge route 76 in a normal state, and can temporarily open the discharge route 76 to the atmosphere.

Figure 18:
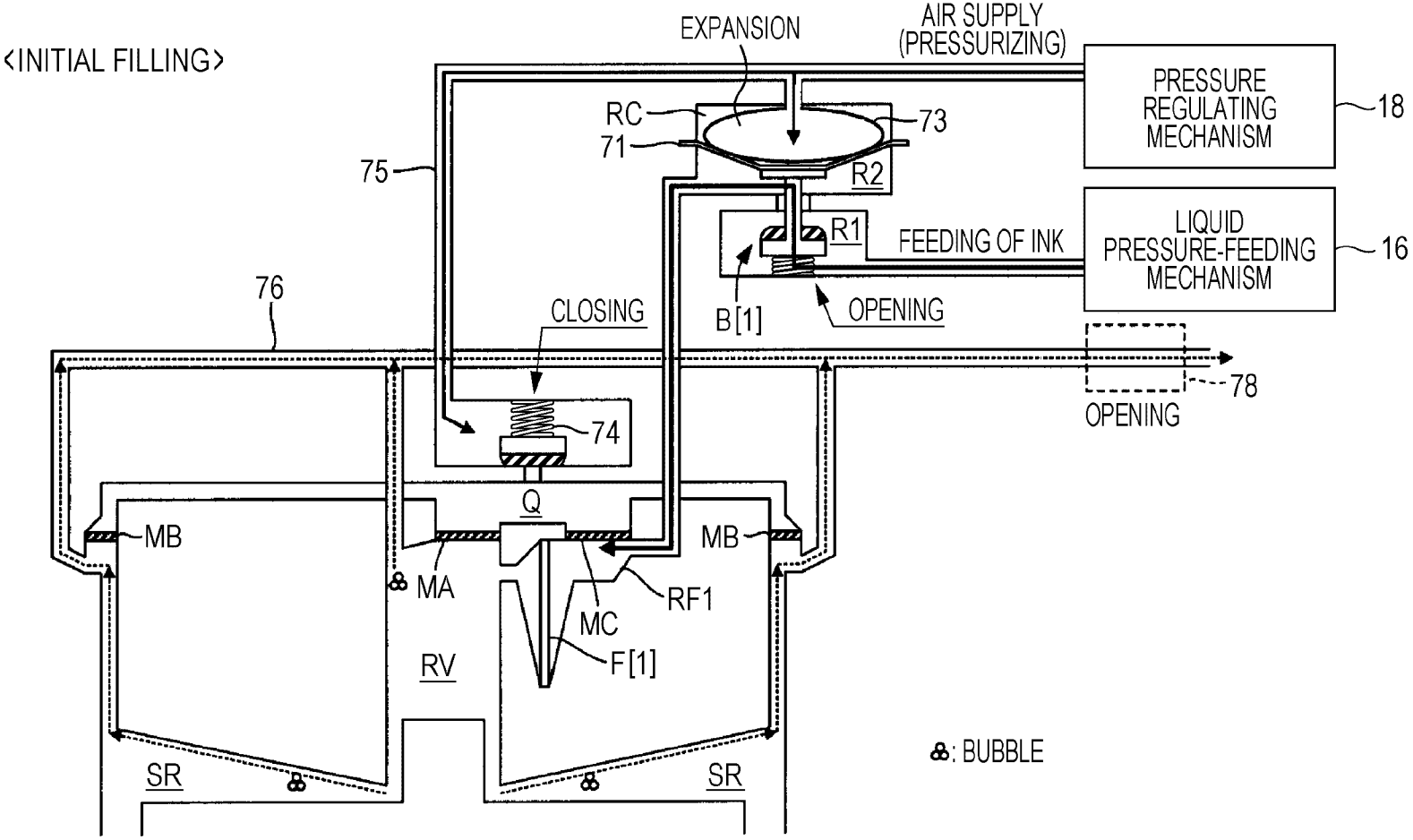
FIG. 18 is a diagram illustrating a state of the liquid ejecting head at the time of initial filling.

An operation of the liquid ejecting unit 40 is described with a focus on the discharge of the bubbles from the internal flow path. As illustrated in FIG. 18, in a stage in which the liquid ejecting unit 40 is filled with the inks for the first time (hereinafter, referred to as "initial filling"), the pressure regulating mechanism 18 performs a pressurizing operation. In other words, the inner space of the pouch-shaped member 73 and the inside of the defoaming route 75 are supplied with air and are pressurized. Hence, the pouch-shaped member 73 inside the control chamber RC is inflated, the movable membrane 71 and the pressure receiving plate 723 are shifted, the pressure receiving plate 723 presses the valve body 722, and the valve body moves. In this manner, the space R1 communicates with the space R2. Since the defoaming space Q is blocked from the defoaming route 75 by the check valve 74 in the state in which the defoaming route 75 is pressurized, the air in the defoaming route 75 does not flow into the defoaming space Q. On the other hand, the closing valve 78 is opened in the stage of the initial filling.

In the state described above, the liquid pressure-feeding mechanism 16 feeds the ink stored in the liquid container 14 to the internal flow path of the liquid ejecting unit 40. Specifically, the ink fed from the liquid pressure-feeding mechanism 16 is supplied to the vertical space RV via the on-off valve B[1] which is in an opened state, and is supplied to the common liquid chamber SR and the pressure chambers SC from the vertical space RV. Since the closing valve 78 is opened as described above, the air, which is present in the internal flow path before the initial filling is performed, is discharged to the outside of the apparatus through the discharge route 76 and the closing valve 78 at the time of filling the internal flow path and the discharge route 76 with the inks. Hence, the entire internal flow path including the common liquid chamber SR and the pressure chambers SC of the liquid ejecting unit 40 is filled with the inks, and an operation of the piezoelectric element 484 enables the inks to be ejected from the nozzles N. As described above, in the first embodiment, since the closing valve 78 is opened when the liquid pressure-feeding mechanism 16 feeds the inks to the liquid ejecting unit 40, it is possible to efficiently fill the internal flow path of the liquid ejecting unit 40 with the inks. When the initial filling described above is completed, the pressurizing operation by the pressure regulating mechanism 18 is stopped and the closing valve 78 is closed.

Figure 19:
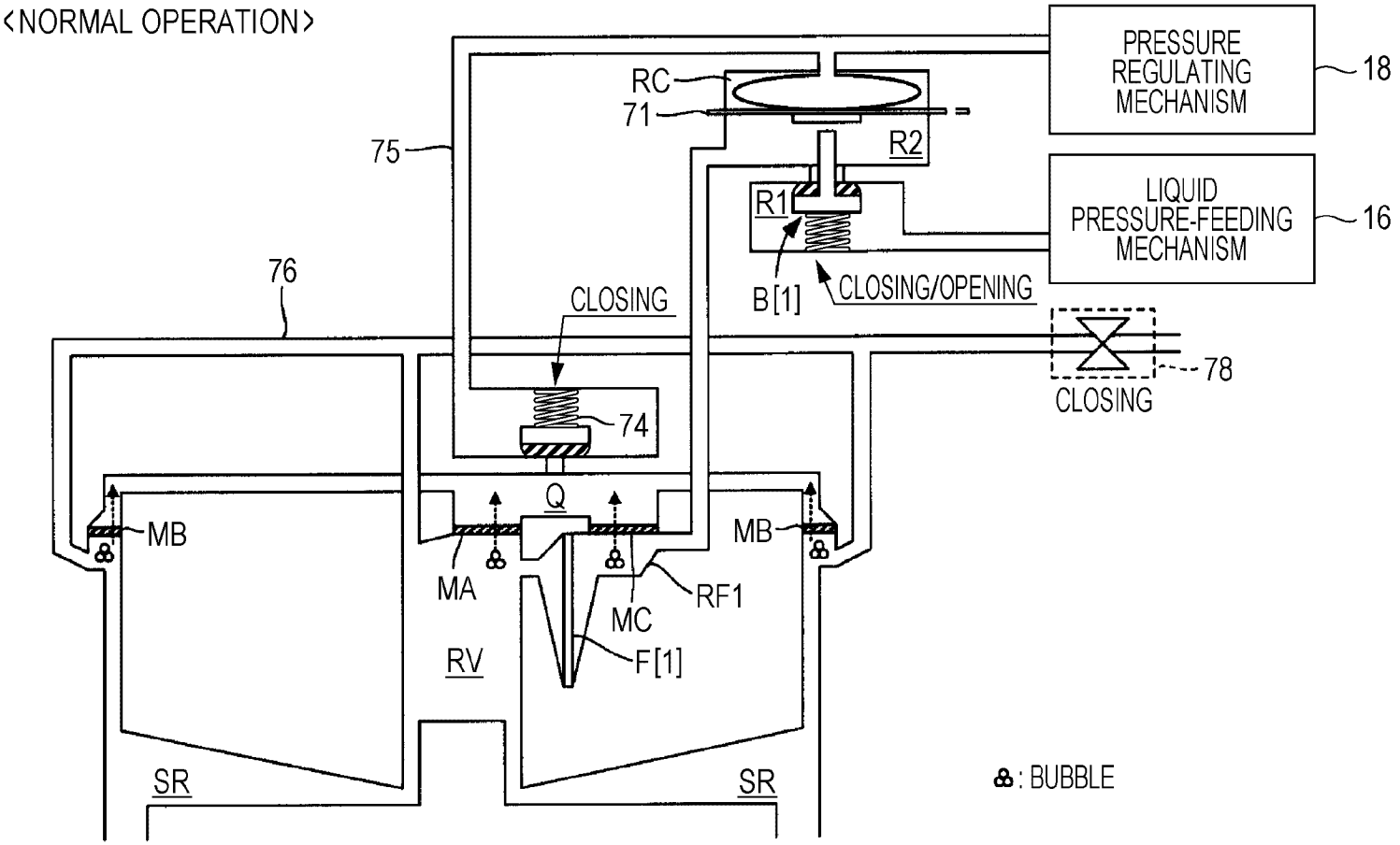
FIG. 19 is a diagram illustrating a state of the liquid ejecting head at the time of a normal operation.

As illustrated in FIG. 19, in a state in which the initial filling is completed and it is possible to use the liquid ejecting apparatus 100, bubbles existing in the internal flow path of the liquid ejecting unit 40 are usually discharged to the defoaming space Q. Specifically, the bubbles in the space RF1 is discharged to the defoaming space Q via the gas permeable membrane MC, the bubbles in the vertical space RV is discharged to the defoaming space Q via the gas permeable membrane MA, and the bubbles in the common liquid chamber SR is discharged to the defoaming space Q via the gas permeable membrane MB. On the other hand, the on-off valve B[1] is closed in a state in which the pressure in the space R2 is maintained within a predetermined range, and is opened when the pressure in the space R2 is lower than a predetermined threshold value. When the on-off valve B[1] is opened, the ink supplied from the liquid pressure-feeding mechanism 16 flows into the space R2 from the space R1. As a result, the pressure in the space R2 increases, and thereby the on-off valve B[1] is closed.

Figure 20:
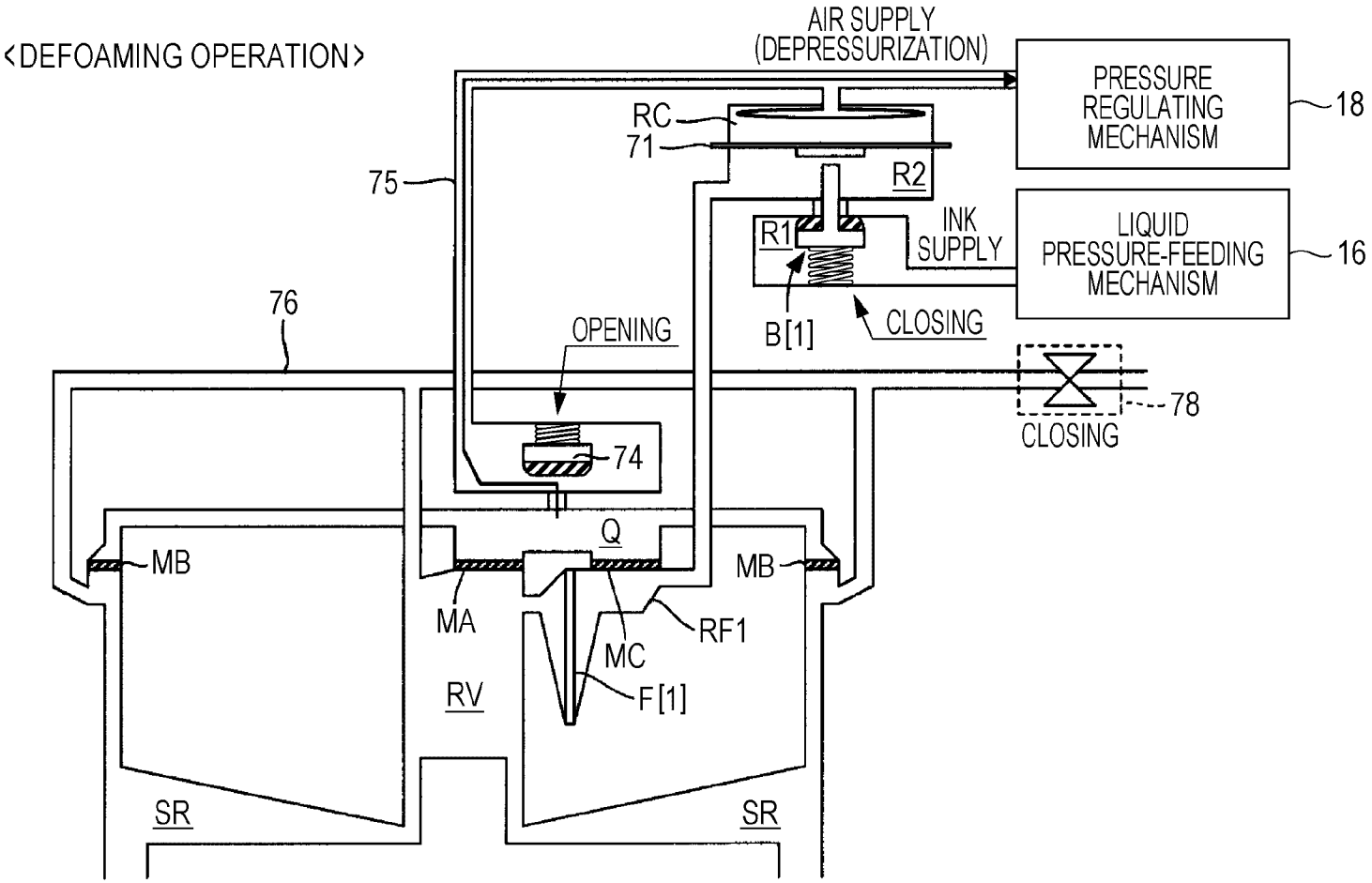
FIG. 20 is a diagram illustrating a state of the liquid ejecting head at the time of a defoaming operation.

The air staying in the defoaming space Q in the operation state illustrated in FIG. 19 is discharged to the outside of the apparatus through a defoaming operation. the defoaming operation can be performed at any time such as immediately after a power supply to the liquid ejecting apparatus 100, between printing operations or during printing (that is, during ejection of the ink from the liquid ejecting portion 44), or the like. FIG. 20 is a diagram illustrating the defoaming operation. As illustrated in FIG. 20, when the defoaming operation is started, the pressure regulating mechanism 18 performs the depressurizing operation. In other words, the inner space of the pouch-shaped member 73 and the inside of the defoaming route 75 depressurizes through the suction of the air.

When the inside of the defoaming route 75 depressurizes, the valve body 742 of the check valve 74 is separated from the valve seat 741 against the spring 743, and the defoaming space Q and the defoaming route 75 communicate with each other via the communicating hole HB. Hence, the air in the defoaming space Q is discharged to the outside of the apparatus via the defoaming route 75. On the other hand, the pouch-shaped member 73 is deflated due to the depressurization of the inner space; however, the on-off valve B[1] is maintained in the closed state because there is no influence on the pressure in the control chamber RC (eventually, the movable membrane 71).

As described above, in the first embodiment, since the pressure regulating mechanism 18 is commonly used for opening and closing the on-off valve B[1] and opening and closing the check valve 74, an advantage is achieved in that a configuration for controlling the on-off valve B[1] and the check valve 74 is simplified, compared to a configuration in which the on-off valve B[1] and the check valve 74 are controlled by separate mechanisms.

Figure 21:
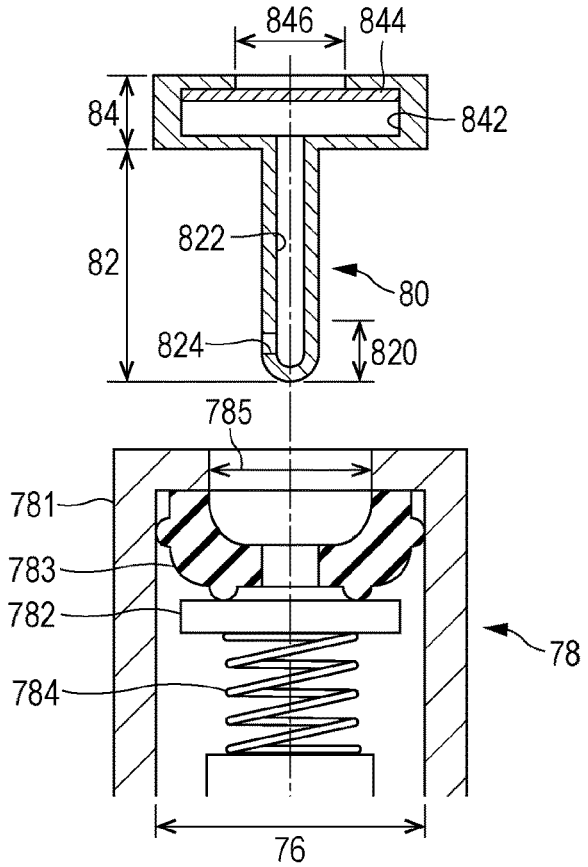
FIG. 21 is a sectional view illustrating a closing valve and an exhaust unit.

A specific configuration of the closing valve 78 in the first embodiment is described. FIG. 21 is a sectional view illustrating the configuration of the closing valve 78. As illustrated in FIG. 21, the closing valve 78 of the first embodiment includes a communicating tube 781, a moving object 782, a seal portion 783, and a spring 784. The communicating tube 781 is a circular tube having an opening 785 on an end surface thereof, and accommodates the moving object 782, the seal portion 783, and the spring 784. An inner space of the communicating tube 781 corresponds to a terminal end portion of the discharge route 76.

The seal portion 783 is an annular member formed of an elastic material such as rubber, and is disposed on one end side of the inner space of the communicating tube 781 so to be concentric with the corresponding communicating tube 781. The moving object 782 is movable on the inner side of the communicating tube 781 in a direction of a central axis of the corresponding communicating tube 781, and comes into close contact with the seal portion 783 with bias from the spring 784, as illustrated in FIG. 21. The moving object 782 and the seal portion 783 come into close contact with each other, and thereby the discharge route 76 inside the communicating tube 781 is closed. As described above, since the moving object 782 is biased to close the discharge route 76, a possibility that bubbles are mixed with the ink in the liquid ejecting unit 40 via the discharge route 76, or a possibility that the ink in the liquid ejecting unit 40 leaks via the discharge route 76 is reduced, during a normal operation (FIG. 19) of the liquid ejecting apparatus 100. On the other hand, when the moving object 782 is separated from the seal portion 783 due to an action of an external force via the opening 785 of the communicating tube 781, the discharge route 76 inside the communicating tube 781 communicates with the outside via the seal portion 783. In other words, the discharge route 76 is in the opened state (FIG. 18).

In order to cause the moving object 782 of the closing valve 78 to move in the stage of the initial filling illustrated in FIG. 18, an exhaust unit 80 in FIG. 21 is used. The exhaust unit 80 of the first embodiment includes an inserting portion 82 and a foundation portion 84. The inserting portion 82 is a needle-shaped portion having a communicating flow path 822 formed inside and an opening 824 communicating with the communicating flow path 822 is formed in a front end portion 820 (on the side opposite to the foundation portion 84). The foundation portion 84 includes a staying space 842 communicating with the communicating flow path 822 of the inserting portion 82, a gas permeable membrane 844 having the gas permeability which closes the communicating flow path 822, and a discharge port 846 formed on the side opposite to the communicating flow path 822 with the gas permeable membrane 844 interposed therebetween.

Figure 22:
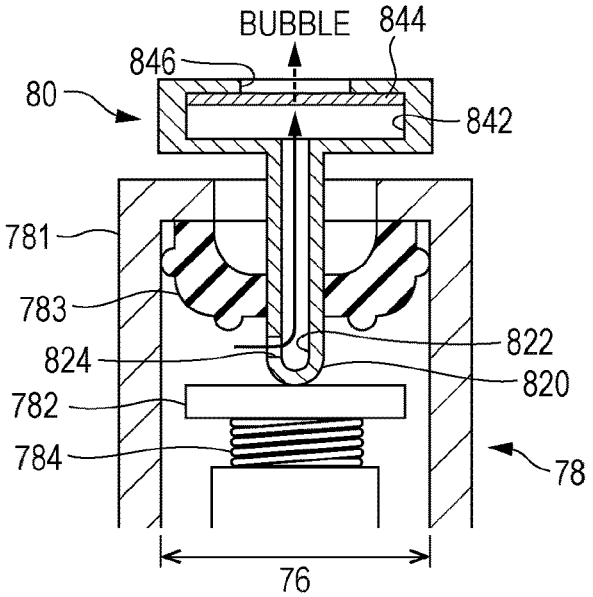
FIG. 22 is a diagram illustrating a state in which the closing valve is opened by using the exhaust unit.

The exhaust unit 80 is attachable to and detachable from the liquid ejecting head 24. Specifically, in the stage of the initial filling, the inserting portion 82 of the exhaust unit 80 is inserted into the communicating tube 781 from the opening 785 as illustrated in FIG. 22. An external force applied from the front end portion 820 of the inserting portion 82 causes the moving object 782 to move in a direction of being separated from the seal portion 783. When the inserting portion 82 is more inserted, an outer circumferential surface of the inserting portion 82 comes into close contact with an inner circumferential surface of the seal portion 783, and the inserting portion 82 is in a state of being held by the seal portion 783. In the state described above, the opening 824 of the inserting portion 82 is positioned on the discharge route 76 side (moving object 782 side) when viewed from the seal portion 783. In other words, the seal portion 783 seals a gap between the outer circumferential surface of the inserting portion 82 on the base end side when viewed from the opening 824 and the inner circumferential surface of the communicating tube 781 (inner circumferential surface of the discharge route 76). Hereinafter, the position of the moving object 782 in the state described above will be described as an "opening position". In the state in which the moving object 782 moves to the opening position, the discharge route 76 communicates with the communicating flow path 822 and the staying space 842 via the opening 824 of the front end portion 820 of the exhaust unit 80. As understood in the above description, in the first embodiment, the insertion of the exhaust unit 80 enables the moving object 782 to simply move to the opening position. In other words, the exhaust unit 80 is mounted on the liquid ejecting head 24, and thereby the closing valve 78 disposed in the internal flow path of the liquid ejecting head 24 is opened.

As described above with reference to FIG. 18, when the liquid pressure-feeding mechanism 16 feeds the ink, the exhaust unit 80 is inserted into the opening 785 of the communicating tube 781, and thereby the moving object 782 moves to the opening position. Hence, the air existing in the internal flow path of the liquid ejecting unit 40 is discharged along with the inks to the discharge route 76, passes through the opening 824 and the communicating flow path 822 as shown with an arrow in FIG. 22, and reaches the staying space 842 of the exhaust unit 80. The bubbles reaching the staying space 842 permeate through the gas permeable membrane 844 and are discharged to the outside from the discharge port 846. As described above, in the first embodiment, since the gas permeable membrane 844 is disposed to close the communicating flow path 822 of the exhaust unit 80, it is possible to reduce a possibility that the liquid having flowed in the communicating flow path 822 from the discharge route 76 will leak from the exhaust unit 80.

In the first embodiment, since the seal portion 783 seals the gap between the outer circumferential surface of the exhaust unit 80 and the inner circumferential surface of the discharge route 76 (inner circumferential surface of the communicating tube 781), it is possible to reduce a possibility that the ink will leak via the gap between the outer circumferential surface of the exhaust unit 80 and the inner circumferential surface of the discharge route 76. In addition, in the first embodiment, the seal portion 783 is commonly used to seal the gap between the outer circumferential surface of the exhaust unit 80 and the inner circumferential surface of the discharge route 76 and to seal the gap between the moving object 782 and the inner circumferential surface of the discharge route 76. Hence, an advantage is achieved in that a structure of the closing valve 78 is simplified, compared to a configuration of using separate members for both cases of the sealing.

The opening 824 of the exhaust unit 80 in the first embodiment communicates with the internal flow path of the liquid ejecting head 24 and the communicating flow path 822 in a state in which the exhaust unit 80 is mounted on the liquid ejecting head 24. As understood in FIG. 21, a flow passage area of the opening 824 is smaller than a flow passage area of the communicating flow path 822. In the configuration described above, a meniscus is easily formed on an inner side of the opening 824, compared to a configuration in which the opening 824 has a large diameter. Hence, an advantage is achieved in that the ink inside the exhaust unit 80 is difficult to leak to the outside thereof even in a case where the exhaust unit 80 is removed from the liquid ejecting head 24 in a state in which the ink reaches the communicating flow path 822 from the internal flow path of the liquid ejecting head 24.

In addition, in the first embodiment, the transport member 262 transports an attaching/detaching portion between the liquid ejecting head 24 and the exhaust unit 80. In other words, the exhaust unit 80 is disposed in the vicinity of the liquid ejecting head 24. Hence, it is possible to reduce an amount of the ink required for filling the liquid ejecting head 24.

Figure 23:
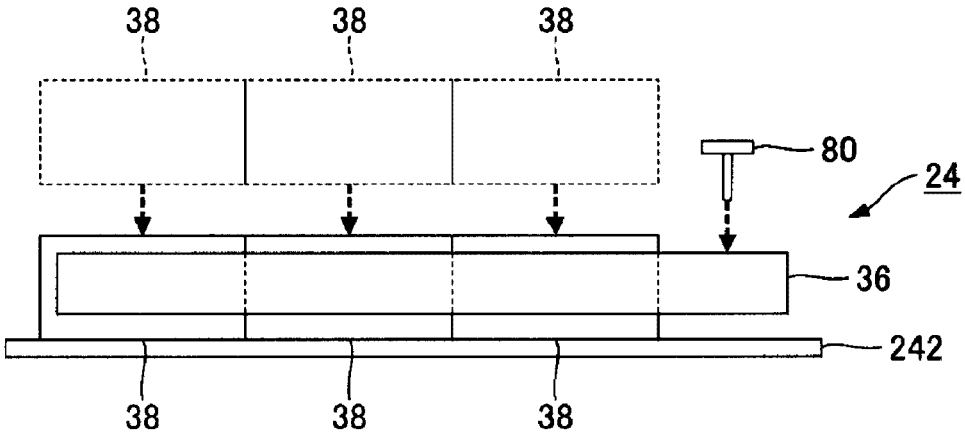
FIG. 23 is a view of a configuration illustrating a relationship between the liquid ejecting module, a flow-path component, and the first support member.

FIG. 23 is a view of a configuration schematically illustrating a structure of the liquid ejecting head 24 in the first embodiment. As described above, the liquid ejecting head 24 of the first embodiment is configured to include the plurality of liquid ejecting modules 38, the flow-path component 36, and the first support member 242 (an example of a support member), as illustrated in FIG. 23. As described above, the plurality of liquid ejecting modules 38 and the flow-path component 36 are disposed on the first support member 242. In other words, the first support member 242 supports the plurality of liquid ejecting modules 38 and the flow-path component 36. The liquid ejecting modules 38 are mounted on the flow-path component 36, and thereby the flow-path component 36 communicates with the liquid ejecting modules 38.

As illustrated in FIG. 23, the exhaust unit 80 is prepared as a separate unit from the liquid ejecting head 24, and is detachably mounted on the liquid ejecting head 24 (specifically, in the communicating tube 781 of the closing valve 78 in the flow-path component 36). The liquid ejecting module 38 is detachably fixed to the first support member 242.

As illustrated in FIG. 23, an attaching/detaching direction of the liquid ejecting module 38 to and from the first support member 242 is the same as an attaching/detaching direction of the exhaust unit 80 to and from the liquid ejecting head 24. Specifically, the liquid ejecting module 38 is caused to move to the positive side in the Z direction and is fixed to the first support member 242, and is removed from the first support member 242 to the negative side in the Z direction. In addition, the exhaust unit 80 is caused to move to the positive side in the Z direction and is mounted on the liquid ejecting head 24 (flow-path component 36), and is removed from the liquid ejecting head 24 to the negative side in the Z direction. As described above, in the first embodiment, since the attaching/detaching direction of the liquid ejecting module 38 to and from the first support member 242 is common to the attaching/detaching direction of the exhaust unit 80 to and from the liquid ejecting head 24, an advantage is achieved in that it is easy to perform attaching/detaching operations of the liquid ejecting module 38 and the exhaust unit 80, respectively.

The liquid ejecting module 38 and the exhaust unit 80 are individually attachable to and detachable from the flow-path component 36. Specifically, while the liquid ejecting module 38 is maintained in the state of being mounted on the flow-path component 36, it is possible to attach and detach the exhaust unit 80 to and from the flow-path component 36. In addition, while the exhaust unit 80 is maintained in the state of being mounted on the flow-path component 36, it is possible to attach and detach the liquid ejecting module 38 to and from the flow-path component 36. As described above, in the first embodiment, since the liquid ejecting module 38 and the exhaust unit 80 are individually attachable to and detachable from the flow-path component 36, an advantage is achieved in that a position of one of the liquid ejecting module 38 and the exhaust unit 80 is difficult to change (difficult to have a positional shift) during the attachment and detachment of the other one.

In addition, in the first embodiment, one exhaust unit 80 is mounted on the flow-path component 36 that communicates with the plurality of liquid ejecting modules 38. In other words, the closing valve 78 is disposed in one system of route in which the discharge route 76 of the plurality of liquid ejecting modules 38 is collectively disposed, and one exhaust unit 80 is mounted on the closing valve 78. As understood in the above description, the gases in the internal flow paths of the plurality of liquid ejecting modules 38 are discharged through the one exhaust unit 80. Hence, an advantage is achieved in that the number of members required for the initial filling or time and effort to perform the initial filling are reduced, compared to a configuration in which one exhaust unit 80 is used for each liquid ejecting module 38. However, a configuration, in which the exhaust units 80 can be individually mounted on the plurality of liquid ejecting modules 38, respectively, may be employed.

Second Embodiment

The second embodiment of the invention is described. Note that elements having the same effects or functions in configurations which will be described below as those in the first embodiment are assigned with the same reference signs used in the description of the first embodiment, and thus detailed descriptions thereof are appropriately omitted.

Figure 24:
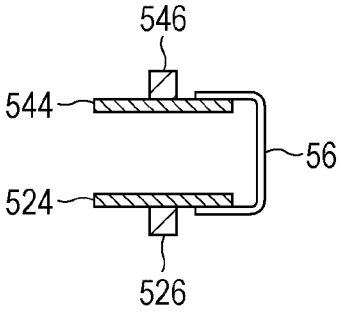
FIG. 24 is a view illustrating disposition of a transmission line in a second embodiment.

FIG. 24 is a view illustrating disposition of the transmission line 56 in the second embodiment. In the first embodiment, as described above with reference to FIG. 6, the configuration, in which the one end of the transmission line 56 is joined to the front surface of the wiring substrate 544 on the side opposite to the connecting portion 546, and the other end of the transmission line 56 is joined to the front surface of the wiring substrate 524 on the side opposite to the connecting portion 526, is described. In the second embodiment, as illustrated in FIG. 24, the one end of the transmission line 56 is joined to the front surface of the wiring substrate 544 on which the connecting portion 546 is disposed, and the other end of the transmission line 56 is joined to the front surface of the wiring substrate 524 on which the connecting portion 526 is disposed. In other words, the transmission line 56 is curved so as to reach the front surface of the wiring substrate 524 on the positive side in the Z direction from the front surface of the wiring substrate 544 on the negative side in the Z direction.

In the configuration in which the transmission line 56 is joined to the front surface thereof on the side opposite to the connecting portion 546 or the connecting portion 526, a conduction hole (via hole) that electrically connects the connecting portion 546 and the transmission line 56 needs to be formed in the wiring substrate 544, and a conduction hole (via hole) that electrically connects the connecting portion 526 and the transmission line 56 needs to be formed in the wiring substrate 524. In the second embodiment, since the one end of the transmission line 56 is joined to the front surface of the wiring substrate 544 on the connecting portion 546 side, and the other end of the transmission line 56 is joined to the front surface of the wiring substrate 524 on the connecting portion 526 side, an advantage is achieved in that there is no need to form the conduction hole reaching both surfaces of the wiring substrate 544 and the wiring substrate 524.

Third Embodiment

Figure 25:
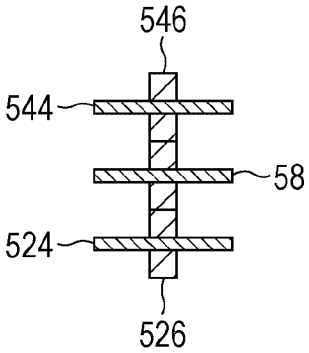
FIG. 25 is a view illustrating a configuration of a connecting unit in a third embodiment.

FIG. 25 is a view illustrating a configuration of the linking unit 50 in the third embodiment. In the first embodiment, the transmission line 56 electrically connects the connecting portion 546 and the liquid ejecting unit 40. In the third embodiment, as illustrated in FIG. 25, a connecting portion 58 electrically connects the connecting portion 546 of the wiring substrate 544 and the connecting portion 384 of the liquid ejecting unit 40. The connecting portion 58 is a connector (board to board connector) of a floating structure, and it is possible to absorb a tolerance with a configuration in which the connecting portion is able to move with respect to a connecting target. Hence, also in the third embodiment similar to the first embodiment, without consideration of the stress acting on the liquid ejecting unit 40 (eventually, a positional shift of the liquid ejecting unit 40) from the connecting portion 546, it is possible to easily assemble or disassemble the liquid ejecting head 24.

As understood in the above description, the transmission line 56 of the first embodiment and the second embodiment and the connecting portion 58 of the third embodiment are disposed between the connecting portion 546 and the liquid ejecting unit 40 so as to absorb the positional error between the connecting portion 546 and the liquid ejecting unit 40, and are collectively referred to as a connecting member that connects the connecting portion 546 and the liquid ejecting unit 40.

Fourth Embodiment

Figure 26:
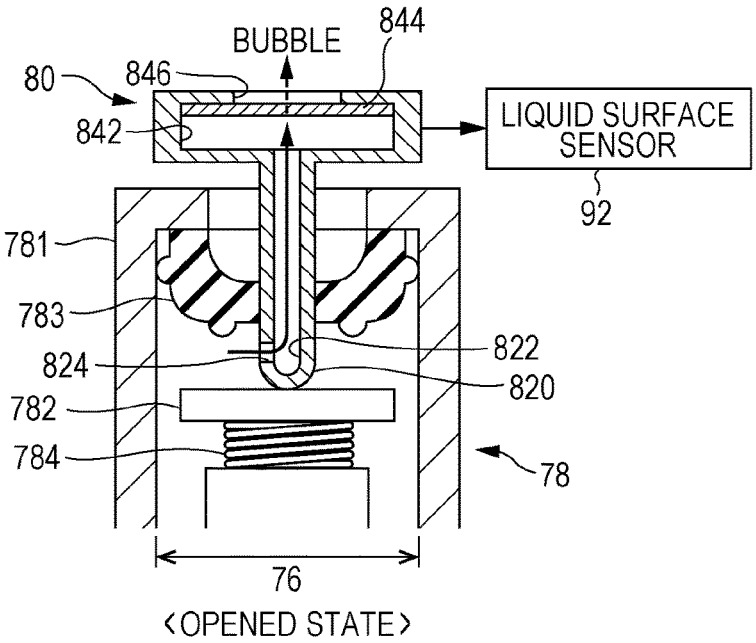
FIG. 26 is a sectional view of an on-off valve and an exhaust unit in a fourth embodiment.

FIG. 26 is a view illustrating a configuration of the closing valve 78 and the exhaust unit 80 in the fourth embodiment. As illustrated in FIG. 26, a liquid surface sensor 92 is connected to the exhaust unit 80 of the fourth embodiment. The liquid surface sensor 92 is a detector that detects a liquid surface in the communicating flow path 822 of the inserting portion 82 of the exhaust unit 80. For example, an optical sensor that receives a reflected light beam from the liquid surface when the inside of the communicating flow path 822 is irradiated with the light beam is suitable for the liquid surface sensor 92. In the process of the initial filling illustrated in FIG. 18, as the liquid pressure-feeding mechanism 16 performs the feeding of the inks to the liquid ejecting unit 40, the liquid surface tends to rise in the communicating flow path 822.

In the process of the initial filling, the control unit 20 of the fourth embodiment controls the feeding of the ink by the liquid pressure-feeding mechanism 16 in response to a detection result by the liquid surface sensor 92. Specifically, in a case where the liquid surface detected by the liquid surface sensor 92 is lower than a predetermined reference position, the liquid pressure-feeding mechanism 16 continues to feed the inks to the liquid ejecting unit 40. On the other hand, in a case where the liquid surface detected by the liquid surface sensor 92 is higher than the reference position, the liquid pressure-feeding mechanism 16 stops feeding the inks to the liquid ejecting unit 40.

In the fourth embodiment, since the feeding of the ink by the liquid pressure-feeding mechanism 16 is controlled in response to the result of the liquid surface in the communicating flow path 822 which is detected by the liquid surface sensor 92, it is possible to reduce an occurrence of excessive supply of the inks to the liquid ejecting unit 40.

Fifth Embodiment

In the fourth embodiment, the configuration in which the operation of the liquid pressure-feeding mechanism 16 is controlled in response to the detection result of the liquid surface in the communicating flow path 822 is described. In the process of the initial filling illustrated in FIG. 18, the control unit 20 of the fifth embodiment controls the feeding of the ink by the liquid pressure-feeding mechanism 16 in response to a detection result of the ink discharged from the nozzles N of the liquid ejecting unit 40. When the inks are excessively supplied to the liquid ejecting unit 40 from the liquid pressure-feeding mechanism 16, the inks can leak from the nozzles N of the liquid ejecting unit 40 even in a state in which the piezoelectric element 484 is not driven. The liquid pressure-feeding mechanism 16 of the fifth embodiment continues to feed the ink to the liquid ejecting unit 40 in a case where a leak of the ink from a specific nozzle N is not detected, and the liquid pressure-feeding mechanism stops feeding the ink in a case where a leak of the ink from the corresponding specific nozzle N is detected. Any method for detecting the leak of the ink may be employed; however, for example, a leak sensor that detects the inks discharged from the nozzles N may be appropriately used. In addition, when a tendency that characteristics of residual vibration in the pressure chamber SC (vibration that continues in the pressure chamber SC after the shift of the piezoelectric element 484) vary depending on an occurrence or nonoccurrence of the leak of the inks from the nozzles N is considered, analysis of the residual vibration makes it possible to detect the leak of the ink.

In the fifth embodiment, since the feeding of the ink by the liquid pressure-feeding mechanism 16 is controlled in response to the detection result of the ink discharged from the nozzles of the liquid ejecting unit 40, it is possible to reduce an occurrence of the excessive supply of the inks to the liquid ejecting unit 40.

Sixth Embodiment

Figure 27:
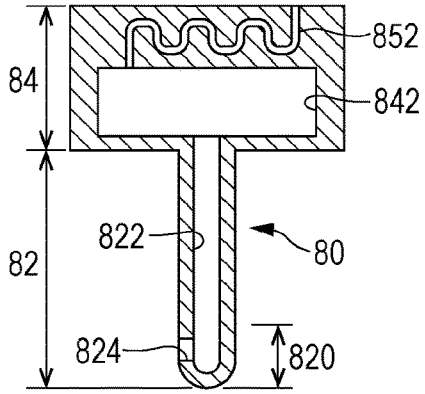
FIG. 27 is a sectional view of an exhaust unit in a sixth embodiment.

FIG. 27 is a sectional view illustrating a configuration of the exhaust unit 80 in the sixth embodiment. Similar to the first embodiment, the exhaust unit 80 illustrated in FIG. 27 is attachable to and detachable from the liquid ejecting head 24 (specifically, the communicating tube 781 of the closing valve 78 in the flow-path component 36). The configuration in which the communicating flow path 822 and the opening 824 are formed in the inserting portion 82 is the same as that in the first embodiment. A flow passage area of the opening 824 is smaller than a flow passage area of the communicating flow path 822.

The foundation portion 84 of the exhaust unit 80 in FIG. 27 includes the staying space 842 and an atmosphere-open route 852. Similar to the first embodiment, the staying space 842 is a space that communicates with the communicating flow path 822 of the inserting portion 82. The atmosphere-open route 852 is an atmosphere opening flow path through which the staying space 842 communicates with the outside. Specifically, the atmosphere-open route 852 is a flow path having a winding (that is, meandering) shape in a cyclic and curved manner. As understood in FIG. 27, a flow passage area of the atmosphere-open route 852 is smaller than the flow passage area of the communicating flow path 822. However, the atmosphere-open route 852 may have any specific shape. For example, it is possible to form the atmosphere-open route 852 having a straight line shape extending from the staying space 842.

Similar to the first embodiment, when the exhaust unit 80 is inserted into the communicating tube 781 and thereby the moving object 782 moves to the opening position, the internal flow path of the liquid ejecting unit 40 communicates with the atmosphere via the opening 824, the communicating flow path 822, the staying space 842, and the atmosphere-open route 852. Hence, the gases in the internal flow path of the liquid ejecting unit 40 are discharged via the communicating flow path 822, the staying space 842, and the atmosphere-open route 852.

As described above, since the gases in the internal flow path of the liquid ejecting head 24 are discharged via the atmosphere-open route 852 of the exhaust unit 80 in FIG. 27, it is possible to efficiently fill the internal flow path of the liquid ejecting head 24 with the inks. In addition, since the flow passage area of the atmosphere-open route 852 is smaller, a meniscus is easily formed on an inner side of the atmosphere-open route 852 in a case where the ink reaches the inside of the exhaust unit 80 from the internal flow path of the liquid ejecting head 24. Hence, when the exhaust unit 80 is removed from the liquid ejecting head 24, an advantage is achieved in that the ink inside the exhaust unit 80 is difficult to leak to the outside thereof. In addition, since the flow passage area of the atmosphere-open route 852 is smaller (a flow-path resistance increases), an advantage is achieved in that the liquid reaching the inside of the exhaust unit 80 is difficult to approach the atmosphere-open route 852.

Figure 28:
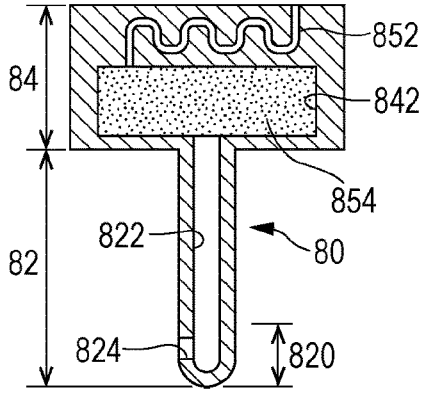
FIG. 28 is a sectional view of an exhaust unit in a modification example of the sixth embodiment.

Note that, as illustrated in FIG. 28, it is also possible to dispose an absorber 854 inside the exhaust unit 80 (for example, inside the staying space 842) in FIG. 27. The absorber 854 is a member such as a sponge that can absorb and hold a liquid. In addition, also similarly, the exhaust unit 80 having the structure illustrated in FIG. 21 can be provided with the same absorber 854 as in FIG. 28 inside the exhaust unit 80 (for example, inside the staying space 842). According to the configuration in which the absorber 854 is disposed inside the exhaust unit 80, an advantage is achieved in that the ink inside the exhaust unit 80 is difficult to leak to the outside thereof even in the case where the ink reaches the inside of the exhaust unit 80 from the internal flow path of the liquid ejecting head 24.

MODIFICATION EXAMPLE

The embodiments described above can be modified in various ways. Specific modification examples are described as follows. Two or more modification examples arbitrarily selected from the following examples can be appropriately combined within a range in which the embodiments are compatible with each other.

(1) In addition to the discharge of the bubbles via the defoaming route 75 and the discharge route 76, the inks in the internal flow path of the liquid ejecting head 24 is suctioned from the nozzles N side, and thereby it is possible to discharge the bubbles from the nozzles N. Specifically, the ejection surface J is covered with a cap in an air-tight manner, a space between the ejection surface J and the cap depressurizes, and thereby the bubbles are discharged along with the inks from the nozzles N. The bubbles existing in the internal flow path of a flow-path structure configured to include the valve mechanism unit 41, the flow-path unit 42, and the housing portion 485 of the liquid ejecting portion 44 are effectively discharged via the defoaming route 75 and the discharge route 76 described in the embodiments described above, and the bubbles existing in the flow paths of the liquid ejecting portion 44 from the diverging flow path 481B to the nozzles N are effectively discharged through the suction from the nozzles N.

(2) In the embodiments described above, the configuration in which the ejection surface J includes the first region P1, the second region P2, and the third region P3 is described; however, one of the second region P2 or the third region P3 may be omitted. In addition, in the embodiments described above, the configuration in which the second region P2 and the third region P3 are positioned on the opposite sides with the center line y interposed therebetween is described; however, it is possible to position the second region P2 and the third region P3 on the same side with respect to the center line y.

(3) The shape of the beam-shaped portion 62 (or the shape of the opening 60) in the first support member 242 is not limited to the shape employed in the embodiments described above. For example, in the embodiments described above, the beam-shaped portion 62 having the shape formed by connecting the first support portion 621, the second support portion 622, and the intermediate portion 623, to each other is described; however, it is possible to form, in the first support member 242, the beam-shaped portion 62 having a shape in which the intermediate portion 623 is omitted (a shape in which the first support portion 621 and the second support portion 622 are separated from each other).

(4) In the embodiments described above, a serial type liquid ejecting apparatus 100 in which the transport member 262, on which the liquid ejecting head 24 is mounted, moves in the X direction is described; however, the invention can be applied to a line type liquid ejecting apparatus in which the plurality of nozzles N of the liquid ejecting head 24 are arranged over the entire width of the medium 12. In the line type liquid ejecting apparatus, the moving mechanism 26 employed in the embodiments described above can be omitted.

(5) The element (drive element) that applies the pressure to the inside of the pressure chamber SC is not limited to the piezoelectric element 484 employed in the embodiments described above. For example, it is also possible to use, as the drive element, a heating element that generates bubbles inside the pressure chamber SC through heating and changes the pressure. As understood in the above example, the drive element is collectively described as an element for ejecting the liquids (usually, element that applies pressure to the inside of the pressure chamber SC), regardless of an operation method (piezoelectric method/heating method) or a specific configuration.

(6) In the embodiments described above, the connecting portions (328, 384, 526, and 546) that are used for electrically connecting are employed; however, the invention can also be applied to a connecting portion for connecting flow paths through which the liquids such as inks circulates. In other words, the connecting member in the invention includes an element that connects the flow path of the first connecting portion and the flow path of the liquid ejecting unit (for example, a tube formed of an elastic material), in addition to the element (for example, the transmission line 56) that electrically connects the first connecting portion and the liquid ejecting unit.

Figure 29:
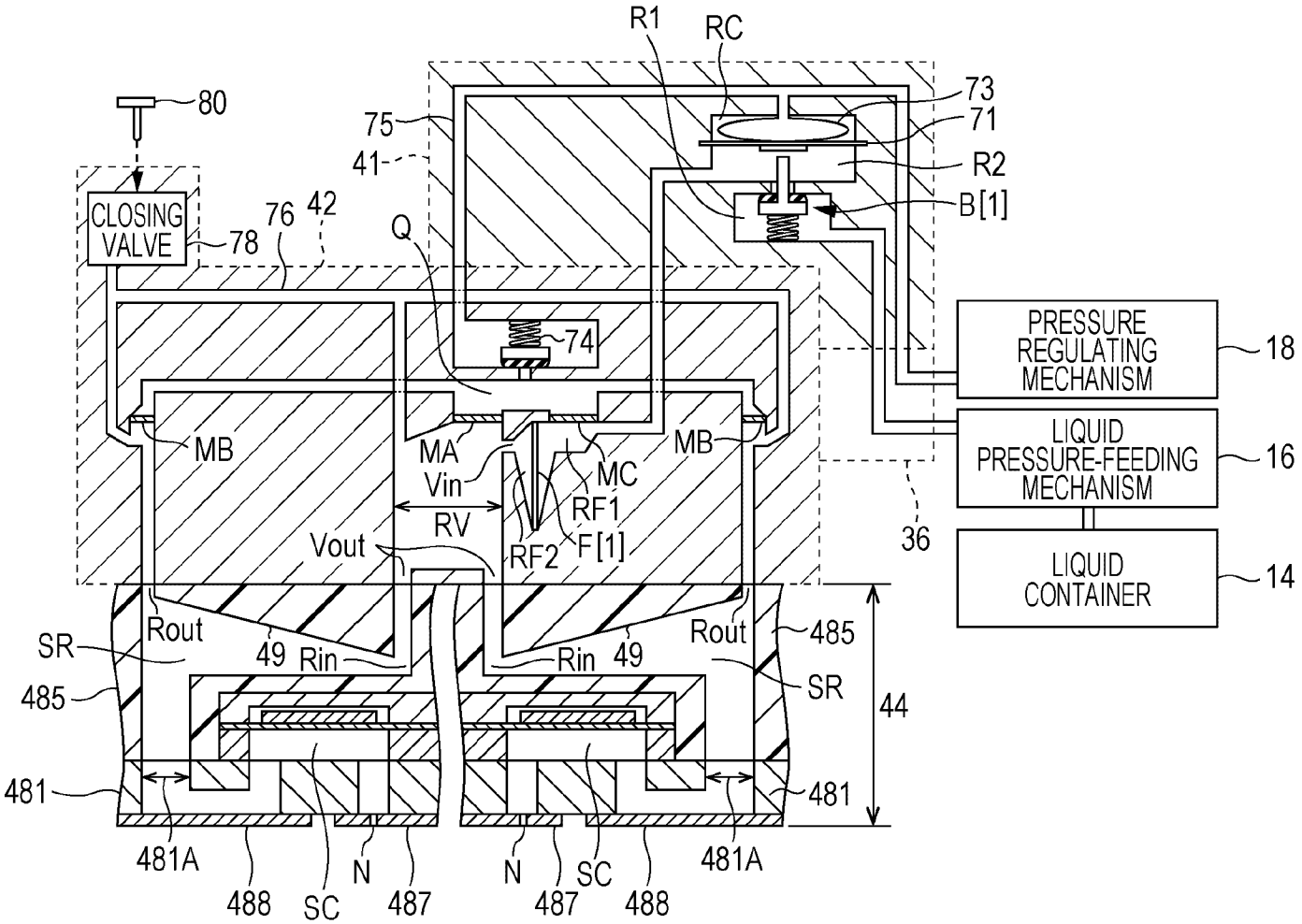
FIG. 29 is a diagram illustrating an internal flow path of a liquid ejecting unit in the modification example.

(7) In the embodiments described above, the configuration in which the exhaust unit 80 for the initial filling is attached to or detached from the flow-path component 36 is described; however, the position at which the exhaust unit 80 is attached and detached is not limited to the positions described above. For example, as illustrated in FIG. 29, a configuration in which it is possible to attach and detach the exhaust unit 80 to and from the liquid ejecting unit 40 (for example, a flow-path unit 42) may be employed. In other words, the embodiments described above are collectively described to have the configuration in which the exhaust unit 80 is attached to and detached from the liquid ejecting head 24. The first embodiment has the configuration in which the exhaust unit 80 is attached to and detached from the flow-path component 36 of the liquid ejecting head 24, and FIG. 29 illustrates a configuration in which the exhaust unit 80 is attached to and detached from the liquid ejecting unit 40 of the liquid ejecting head 24.

(8) In the embodiments described above, both of the supply flow path for supplying the inks to the plurality of liquid ejecting modules 38, respectively, from the liquid pressure-feeding mechanism 16, and the discharge route 76 for discharging the gases from the internal flow path of the liquid ejecting unit 40 are formed in the single flow-path component 36; however, it is possible to form the supply flow path and the discharge route 76 in the separate flow-path components 36. In other words, the flow-path component 36 can be configured of a plurality of components separate from each other, in addition to the single component. One of the supply flow path or the discharge route 76 is formed in the flow-path component, and the other may or may not be formed. Note that the ink reaching the discharge route 76 during the initial filling can be solidified. Hence, it is desirable that the flow-path component including the discharge route 76 be a component that is attachable to and detachable from the liquid ejecting head 24 so as to be replaced, for example, along with the exhaust unit 80.

(9) In the embodiments described above, the gas permeable membranes (MA, MB, and MC) separate from the members (hereinafter, referred to as flow-path forming members") that configure the internal flow path of the flow-path structure are employed; however, it is possible to integrally form the gas permeable membrane with the flow-path forming members. Specifically, a portion of the flow-path forming member which is in contact with the defoaming space Q is molded to be sufficiently thin, and thereby it is possible to use the portion as the gas permeable membranes (MA, MB, and MC). In other words, when the region (wall surface) of the flow-path forming member which is in contact with the defoaming space Q is configured to allow the gases to permeate, compared to a region which is not in contact with the defoaming space Q, it is possible to use, as the gas permeable membranes (MA, MB, and MC), the region which is in contact with the defoaming space Q. Similar to the gas permeable membrane 844, it is possible to integrally form the portion with the exhaust unit 80.

What is claimed is:

1. A liquid ejecting apparatus comprising:

a liquid ejecting unit for ejecting a liquid supplied to an internal flow path;

a pump configured to feed the liquid to the liquid ejecting unit;

a discharge route that communicates with the internal flow path and receives the liquid from a liquid ejecting portion of the liquid ejecting unit; and a closing valve disposed in and at a terminal, downstream end of the discharge route, wherein the closing valve has an object that is biased to close the discharge route, and wherein the object is configured to open the discharge route, due to an external force, during feeding of the liquid by the pump to the liquid ejecting portion.

2. The liquid ejecting apparatus according to claim 1, wherein the object is configured to move due to the external force that is applied from a front end portion of an exhaust unit inside which a communicating flow path communicating with an opening on the front end portion side is formed.

3. The liquid ejecting apparatus according to claim 2, wherein the closing valve has a seal portion that seals a gap between an inner circumferential surface of the discharge route and an outer circumferential surface of the exhaust unit on a base end side when viewed from the opening.

4. The liquid ejecting apparatus according to claim 3, wherein the seal portion comes into contact with the moving object to which the external force is not applied.

5. The liquid ejecting apparatus according to claim 2, wherein the exhaust unit includes a gas permeable membrane that closes the communicating flow path.

6. The liquid ejecting apparatus according to claim 2, wherein the pump is configured to stop the liquid from being fed, in response to a detection result from a liquid surface sensor that detects a liquid surface in the communicating flow path.

7. The liquid ejecting apparatus according to claim 2, wherein the pump is configured to stop the liquid from being fed, in response to a detection result of a liquid discharged from a nozzle of the liquid ejecting unit received from a liquid surface sensor.

* * * * *